US012588769B2

(12) United States Patent
Tackaberry et al.

(10) Patent No.: US 12,588,769 B2
(45) Date of Patent: Mar. 31, 2026

(54) CONVERTIBLE INFANT CHAIR ASSEMBLY

(71) Applicant: Baby Generation, Inc., New York, NY (US)

(72) Inventors: Jillian Kaye Tackaberry, Chicago, IL (US); Matteo Iavicoli, Chicago, IL (US); Gary Paulsen, Chicago, IL (US); Jeremy Paul Grodkiewicz, Portland, OR (US); Stephen R. Burns, Cumming, GA (US)

(73) Assignee: BABY GENERATION, INC., New York, NY (US)

( * ) Notice: Subject to any disclaimer, the term of this patent is extended or adjusted under 35 U.S.C. 154(b) by 172 days.

(21) Appl. No.: 18/397,632

(22) Filed: Dec. 27, 2023

(65) Prior Publication Data

US 2025/0064226 A1 Feb. 27, 2025

Related U.S. Application Data

(60) Provisional application No. 63/578,185, filed on Aug. 23, 2023.

(51) Int. Cl.
*A47D 1/00* (2006.01)
*A47D 15/00* (2006.01)

(52) U.S. Cl.
CPC ..... *A47D 1/004* (2013.01); *A47D 1/0081* (2017.05); *A47D 1/0083* (2017.05);
(Continued)

(58) Field of Classification Search
CPC .... A47D 15/005; A47D 15/006; A47D 1/008; A47D 1/0081; A47D 1/0083;
(Continued)

(56) References Cited

U.S. PATENT DOCUMENTS 1,939,062 A * 12/1933 Knight ..... A62B 35/0018 24/DIG. 30
2,817,393 A * 12/1957 Mitchell ..... A47D 15/006 297/484

(Continued)

FOREIGN PATENT DOCUMENTS

AU 2015100116 A4 * 3/2015 ..... A47D 15/006
EP 3295832 A1 3/2018

(Continued)

OTHER PUBLICATIONS

Nesta Natural Maxi-Cosi, Maxi-Cosi, https://www.welcomemrbaby.com/nesta-natural-maxi-cosi.html (last visited: Apr. 4, 2024).

(Continued)

*Primary Examiner* — Rodney B White
(74) *Attorney, Agent, or Firm* — Perilla Knox & Hildebrandt LLP; Kenneth A. Knox

(57) ABSTRACT

A convertible highchair is described that includes a bucket seat with a contoured backrest and an adjustable harness to securely and comfortably hold an infant in place while eating or performing various activities. The bucket seat, acting as an infant seat, is also removable to accommodate infants of different sizes and ages. For instance, the bucket seat can be removed to transition the highchair from use as a baby feeding chair to use as a toddler feeding chair, where a toddler seat is height adjustable. The highchair also features a removable tray that is adjustable in distance from the infant to allow for easy access to food and drinks. The tray can also be equipped with a spill-resistant lip to prevent food and drinks from spilling onto the infant's lap or the floor. The highchair also includes a sturdy base with legs that ensure stability on various surfaces.

24 Claims, 24 Drawing Sheets

(52) U.S. Cl.
CPC ..... *A47D 1/0085* (2017.05); *A47D 15/005* (2013.01); *A47D 15/006* (2013.01); *A47D 1/008* (2013.01)

(58) Field of Classification Search
CPC .. A47D 1/0085; A62B 35/00; A62B 35/0006; A62B 35/0012; B60R 22/10; B60R 22/105
See application file for complete search history.

(56) References Cited

U.S. PATENT DOCUMENTS 3,954,280 A * 5/1976 Roberts ..... B60R 22/105 297/484 X
4,197,816 A * 4/1980 Lusch ..... A62B 35/0006 182/6
4,298,648 A 11/1981 Turnbull
4,709,966 A * 12/1987 Parkinson ..... B60R 22/105 297/484
4,927,211 A * 5/1990 Bolcerek ..... A47D 15/006 297/484
5,036,548 A * 8/1991 Grilliot ..... A62B 35/0006 2/81
5,091,243 A * 2/1992 Tolbert ..... A47C 31/001 428/920
5,507,550 A 4/1996 Maloney
5,540,403 A * 7/1996 Standley ..... B60R 22/105 297/465 X
5,709,920 A * 1/1998 Danton ..... A47C 7/26 428/68
6,050,643 A 4/2000 Kain et al.
6,082,814 A 7/2000 Celestina-Krevh et al.
6,293,623 B1 9/2001 Kain et al.
6,338,887 B1 * 1/2002 Derud ..... A47C 27/008 442/305
6,364,417 B1 * 4/2002 Silverman ..... B60R 22/105 297/484
6,863,350 B1 * 3/2005 McCulley ..... B60N 2/2812 297/467 X
7,770,969 B2 * 8/2010 Boyle ..... B60N 2/2809 297/484
7,832,801 B2 11/2010 Driessen
7,918,497 B2 4/2011 Keegan
8,015,619 B2 * 9/2011 McKay ..... A62B 35/0006 2/69
8,124,684 B2 2/2012 Spaan et al.
8,157,327 B2 4/2012 Tomasi
8,240,765 B2 8/2012 Kennedy et al.
8,297,694 B2 10/2012 Arnold et al.
8,408,650 B2 * 4/2013 Jacobs ..... A47D 1/006 297/130
8,434,827 B2 5/2013 Young et al.
D691,819 S 10/2013 Kittilsen et al.
8,567,867 B2 10/2013 Arnold et al.
8,616,632 B2 * 12/2013 Cheng ..... B60N 2/2809 297/216.11
9,113,721 B2 8/2015 Dignitti et al.
9,119,481 B2 9/2015 Varney et al.
9,161,636 B2 10/2015 Opsvik et al.
9,168,401 B2 * 10/2015 Botti ..... A62B 35/0025
D742,654 S 11/2015 Opsvik
9,192,248 B2 * 11/2015 Wigzell ..... B60N 2/2812
D779,842 S 2/2017 Chuah
9,560,919 B2 * 2/2017 Terhune ..... A47D 1/0081
9,561,776 B2 * 2/2017 Friedman ..... B60N 2/274
9,635,955 B2 5/2017 Greger
9,669,797 B2 * 6/2017 Friedman ..... B60N 2/274
9,713,968 B1 * 7/2017 Richardson ..... B60R 22/105
9,715,806 B2 * 7/2017 Pham ..... A62B 35/0025
9,788,662 B1 10/2017 Hollett et al.
9,861,840 B2 * 1/2018 Moore, Jr. ..... G01W 1/02
10,080,443 B2 * 9/2018 Terhune ..... A47D 1/0085
10,259,423 B2 * 4/2019 Friedman ..... B60N 2/274
10,293,713 B2 * 5/2019 Anderson ..... B60N 2/286
10,413,086 B2 9/2019 Waldman et al.
10,414,373 B2 * 9/2019 Osei-Owusu ..... B60R 22/12
10,442,451 B2 10/2019 Burns et al.
10,457,246 B2 * 10/2019 Coakley ..... B60N 2/2812
10,477,981 B2 11/2019 Burns et al.
10,588,421 B2 * 3/2020 Terhune ..... A47D 1/006
10,640,078 B1 * 5/2020 Siegel ..... B60R 22/105
10,661,749 B2 * 5/2020 Kim ..... B60R 22/105
10,710,545 B2 * 7/2020 Friedman ..... B60N 2/2812
D912,412 S 3/2021 Kittilsen
11,019,854 B1 6/2021 Lee
11,040,694 B1 * 6/2021 Siegel ..... B60R 22/105
11,147,391 B2 * 10/2021 Terhune ..... A47D 15/006
11,172,764 B2 * 11/2021 Tackaberry ..... A47D 1/002
D943,297 S 2/2022 Tackaberry et al.
11,259,648 B2 3/2022 Dziak et al.
11,259,650 B2 * 3/2022 Tsui ..... A47D 1/002
11,312,270 B2 * 4/2022 Greenberg ..... B60R 22/26
11,618,352 B2 * 4/2023 Friedman ..... B60N 2/271 297/484
11,622,632 B2 * 4/2023 Tackaberry ..... A47D 1/002 297/134
11,833,939 B2 * 12/2023 Greenberg ..... B60R 22/26
11,904,741 B2 * 2/2024 Shibata ..... A47D 13/025
11,969,107 B2 * 4/2024 Shibata ..... B60N 2/2887
D1,025,622 S 5/2024 Rong
11,974,639 B2 * 5/2024 Sepe ..... A44B 11/2553
D1,041,926 S 9/2024 Chuah
D1,043,140 S 9/2024 Rong
D1,043,141 S 9/2024 Rong
12,257,928 B2 * 3/2025 Greenberg ..... B60R 22/26
12,274,376 B2 * 4/2025 Andersen ..... A47D 1/103
2002/0074835 A1 6/2002 Chalender
2004/0169411 A1 * 9/2004 Murray ..... B60R 22/105 297/486 X
2011/0095593 A1 4/2011 Angelfoss
2011/0168488 A1 * 7/2011 Simard ..... A62B 1/14 182/5
2012/0217090 A1 * 8/2012 Green ..... A62B 35/0025 182/8
2013/0087993 A1 4/2013 Jacquet et al.
2016/0309909 A1 10/2016 Cosetllo et al.
2017/0119172 A1 5/2017 Sclare et al.
2017/0273476 A1 * 9/2017 Thomson ..... A47D 15/006
2017/0311733 A1 11/2017 Winterhalter et al.
2019/0077364 A1 * 3/2019 Murray, Sr. ..... B60R 22/023
2019/0351981 A1 * 11/2019 Kerr ..... B63H 9/1007
2020/0170419 A1 6/2020 Sclare et al.
2020/0339061 A1 * 10/2020 Friedman ..... B60R 22/105
2021/0037989 A1 2/2021 Rogers et al.
2021/0212291 A1 * 7/2021 Su ..... B60R 22/10
2021/0361076 A1 11/2021 Mountz et al.
2021/0393045 A1 12/2021 Kostyniak et al.
2021/0401190 A1 12/2021 Tyneski et al.
2022/0071400 A1 3/2022 Tackaberry et al.
2022/0354271 A1 * 11/2022 Shibata ..... A47D 15/006
2023/0347800 A1 * 11/2023 Friedman ..... B60R 22/105
2024/0423388 A1 * 12/2024 Phung ..... A47D 15/006
2025/0178792 A1 * 6/2025 Mah ..... A41D 1/08

FOREIGN PATENT DOCUMENTS

EP 3738820 A1 * 11/2020 ..... B60N 2/2809
EP 3876795 A1 9/2021
GB 291267 A * 5/1928 ..... A62B 35/0006
GB 361859 A * 11/1931 ..... A62B 35/00
GB 2230690 A * 10/1990 ..... A62B 35/0018
GB 2465987 A * 6/2010 ..... A47D 1/023
GB 2537422 A * 10/2016 ..... B60N 2/30
GB 2585088 A * 12/2020 ..... B60N 2/2812
JP 2002242076 A 8/2002
WO 2008061341 A1 5/2008
WO WO-2010097824 A1 * 9/2010 ..... B64D 17/30
WO WO-2021124404 A1 * 6/2021 ..... A62B 35/0025
WO 2021156716 A1 8/2021
WO 2022061332 A2 6/2022

(56) References Cited

OTHER PUBLICATIONS

Toddler Kit for Nesta Natural Maxi-Cosi, Maxi-Cosi, https://www.welcomemrbaby.com/toddler-kit-for-nesta-beyond-sky-grey-maxi-cosi.html (last visited: Apr. 4, 2024).
Notice of Allowance for Design U.S. Appl. No. 29/915,470 of Nov. 21, 2024.

* cited by examiner

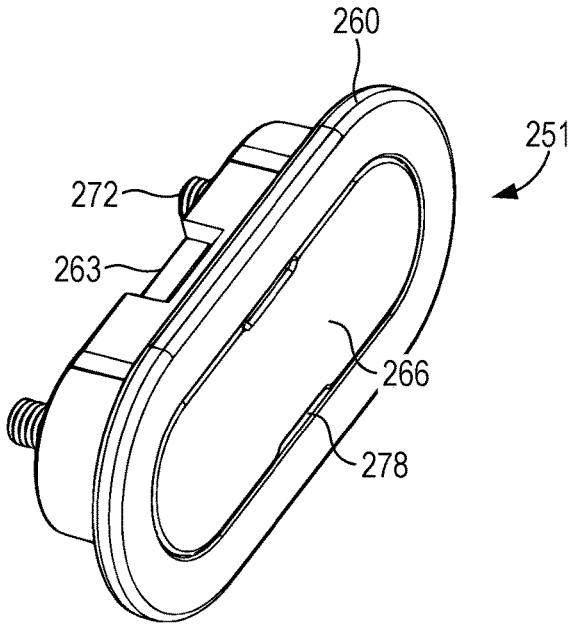
FIG. 20
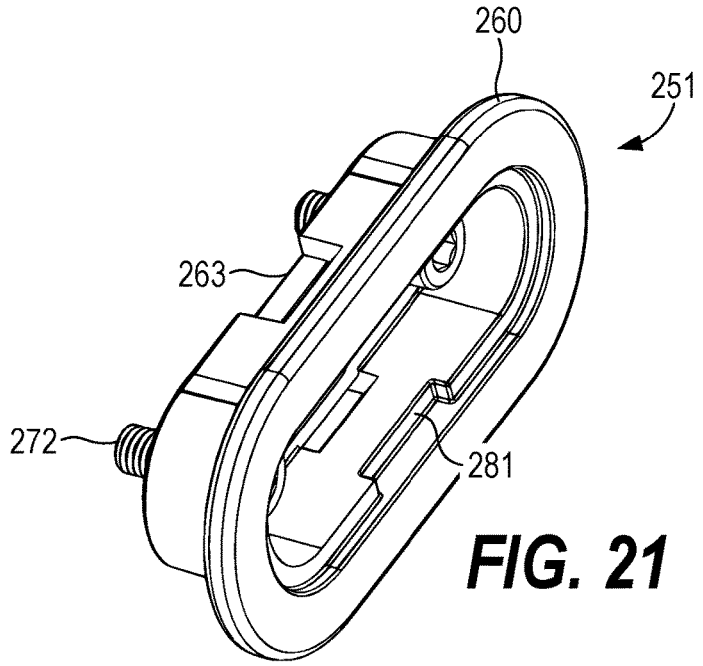
FIG. 21
FIG. 22
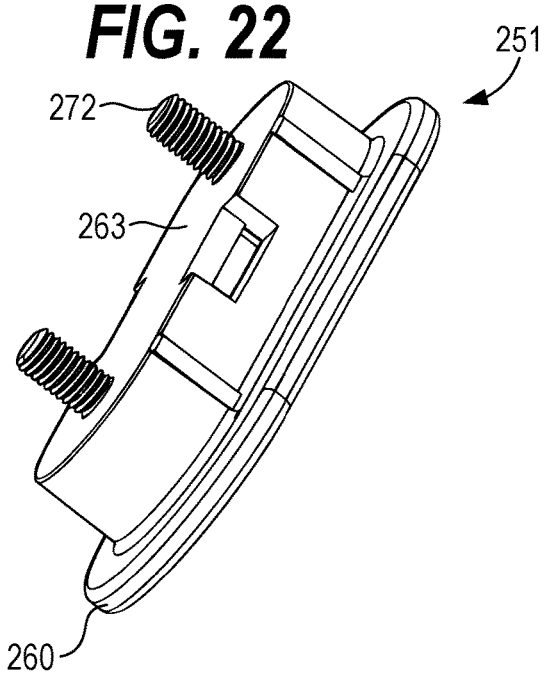
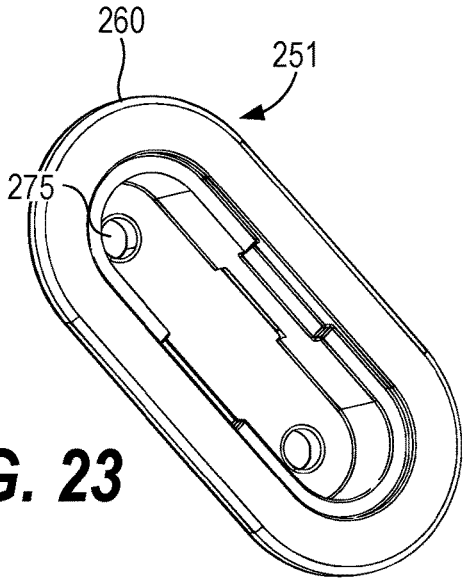
FIG. 23

CONVERTIBLE INFANT CHAIR ASSEMBLY

CROSS-REFERENCE TO RELATED APPLICATION

This application claims the benefit of and priority to U.S. Provisional Patent Application No. 63/578,185 filed Aug. 23, 2023 entitled "Convertible Infant Chair Assembly," the contents of which being incorporated by reference in its entirety herein.

BACKGROUND

Feeding infants, including babies and toddlers, can be a challenging task, as infants require proper support and stability during feeding. Existing infant feeding chairs, also referred to generally as "highchairs," do not provide adequate support, stability, and adjustability to ensure that infants are safely and comfortably positioned during feeding. Existing chair designs tend to be cumbersome, difficult to assemble, may be unusable as an infant grows, and are difficult to operate.

TECHNICAL FIELD

The present disclosure relates to infant highchairs and, in particular, to a highchair that is convertible between an infant chair and a toddler chair with improved functionality for feeding infants.

BRIEF SUMMARY

In a first aspect, an infant chair assembly is described, comprising: a support frame; an infant seat assembly, the infant seat assembly comprising a seat configured to support an infant in a seated position; and a harness assembly secured to the seat without having passed through or secured to a backside of the seat, the harness assembly comprising shoulder straps, waist straps, and a crotch strap, the crotch strap being secured to the front portion of the infant seat. The shoulder straps and waist straps are detachably attachable to a buckle, and at least one of the shoulder straps, the waist straps, and the crotch strap are formed, at least in part, of a fiber-reinforced, silicone coated material.

In some aspects, all of the shoulder straps, the waist straps, and the crotch strap are formed, at least in part, of the fiber-reinforced, silicone coated material. The infant chair assembly can further include a crotch post, wherein the crotch post comprises two horizontally-extending top members and a vertically-extending central member positioned orthogonal to the two horizontally-extending top members; and a notch and a notch lip positioned between the two horizontally-extending top members.

The chair assembly can further include a tray having a bottom surface and a projection extending downward relative to the bottom surface, the projection being sized and positioned to be positioned in and form an engagement with the notch and the notch lip of the crotch post. The projection comprises a top projection portion and a bottom projection portion coupled to one another; and the top projection portion has a width less than a width of the notch and the notch lip, and the bottom projection portion has a width greater than the notch and the notch lip such that the top projection portion is nested within the notch, and the bottom projection portion is positioned below the notch lip, creating pressure between the projection and the notch lip of the crotch post.

In a second aspect, a convertible infant chair assembly is described, comprising: a support frame; an infant seat assembly detachably attachable to the support frame, the infant seat assembly comprising a bucket seat configured to support an infant in a seated position; and a strap hub positioned at a backrest of the bucket seat, the strap hub comprising first and second ends disposed opposite one another, two vertically-oriented apertures disposed on the first and second ends, and two horizontally-oriented apertures. The strap hub comprises a front portion having a contoured front surface, a rear portion having a body angled relative to the front portion, and an arm extending between the front portion and the rear portion. The backrest of the bucket seat comprises an aperture. The arm is disposed through the aperture such that the strap hub is fixed to the bucket seat and such that the countered front surface of the front portion is substantially flush with the backrest of the bucket seat.

The convertible infant chair assembly can further include a harness assembly comprising strapping, the strapping comprising: a first shoulder strap disposed through a first one of the two vertically-oriented apertures and a first one of the two horizontally-oriented apertures; a second shoulder strap disposed through a second one of the two vertically-oriented apertures and a second one of the two horizontally-oriented apertures; a crotch strap disposed through a bottom aperture of the bucket seat; and a buckle, wherein the first shoulder strap and the second shoulder strap are detachably attachable to the buckle. At least a portion of the strapping is formed of a silicone material or a fiber-reinforced silicone-coated material.

The convertible infant chair assembly can further include a toddler seat assembly comprising at least two of a backrest separate from the backrest of the bucket seat; a toddler seat; and a footrest. The support frame comprises a plurality of support frame legs having a plurality of toddler seat tracks disposed on inner surfaces of the support frame legs, the toddler seat having a variable height adjustable relative to the backrest of the toddler seat assembly via the plurality of toddler seat tracks. The infant seat assembly comprises a rear support projecting from a rear surface of the bucket seat, the rear support comprising an edge configured to engage a surface of a toddler seat backrest. The convertible infant chair assembly can further include a tray and a tray liner detachably attachable to the tray, the tray being configured to adjust horizontally relative to the bucket seat.

In a third aspect, a convertible infant chair assembly is described, comprising: a support frame; an infant seat assembly detachably attachable to the support frame, the infant seat assembly comprising a bucket seat configured to support an infant in a seated position; and a strap hub positioned at a backrest of the bucket seat, the strap hub comprising first and second ends disposed opposite one another, two vertically-oriented apertures disposed on the first and second ends, and two horizontally-oriented apertures positioned between the two vertically-oriented apertures. The strap hub further comprises a front portion having a contoured front surface, a rear portion having a body angled relative to the front portion, and an arm extending between the front portion and the rear portion. The backrest of the bucket seat comprises an aperture. The arm is disposed through the aperture such that the strap hub is rigidly fixed to the bucket seat and such that the countered front surface of the front portion is substantially flush with the backrest of the bucket seat.

The convertible infant chair assembly further comprises a harness assembly comprising strapping, the strapping comprising: a first shoulder strap disposed through a first one of the two vertically-oriented apertures and a first one of the two horizontally-oriented apertures; a second shoulder strap disposed through a second one of the two vertically-oriented apertures and a second one of the two horizontally-oriented apertures; a crotch strap disposed through a bottom aperture of the bucket seat; and a buckle, wherein the first shoulder strap and the second shoulder strap are detachably attachable to the buckle. At least a portion of the strapping is formed of a silicone material or a fiber-reinforced silicone-coated material.

The convertible infant chair assembly further includes a toddler seat assembly comprising at least two of a backrest separate from the backrest of the bucket seat; a toddler seat; and a footrest. The support frame comprises a plurality of support frame legs having a plurality of toddler seat tracks disposed on inner surfaces of the support frame legs, the toddler seat having a height adjustable relative to the backrest of the toddler seat assembly via the plurality of toddler seat tracks.

The toddler seat tracks are raceways comprising elongated recessed regions disposed in the inner surfaces of the support frame legs; and the convertible infant chair assembly further comprises a coupling mechanism coupled to a bottom surface of a toddler seat, the coupling mechanism comprising an aperture, and a pull knob being positioned through the aperture that mates the coupling mechanism to the inner surfaces of the support frame legs. The pull knob is a threaded pull knob capable of being twisted and pulled, thereby causing a rod to threadedly decouple from a slot nested in the raceways. The infant seat assembly comprises a rear support projecting from a rear surface of the bucket seat, the rear support comprising an edge configured to engage a surface of a toddler seat backrest. The convertible infant chair assembly further comprises a tray and a tray liner detachably attachable to the tray, the tray being configured to adjust horizontally relative to the bucket seat.

The convertible infant chair assembly further comprises support frame legs of the support frame, a bucket seat connector, and a coupling mechanism, the bucket seat connector and the coupling mechanism both being detachably attached to an inner surface of the support frame legs. The bucket seat comprises side bodies that project laterally from the bucket seat and the side bodies each comprise a recess in which the bucket seat connector and the coupling mechanism are slidably disposed. The coupling mechanism is ovular-shaped and comprises a lip, a projection disposed within the recess configured to slide over and engage with the lip to form an interference connection therewith. The bucket seat connector comprises a seat engagement and a plurality of clips, a bottom of the side bodies of the bucket seat configured to be positioned in the recess such that the seat engagement contacts an interior top surface of the recess and the clips engage interior sidewalls of the recess.

In a fourth aspect, a convertible infant chair assembly is described, comprising: a support frame; an infant seat assembly detachably attachable to the support frame, the infant seat assembly comprising a bucket seat configured to support an infant in a seated position; and a bucket seat connector and a coupling mechanism both detachably attached to an inner surface of the support frame. The bucket seat comprises side bodies that project laterally from the bucket seat and the side bodies each comprise a recess in which the bucket seat connector and the coupling mechanism are slidably disposed.

The convertible infant chair assembly further comprises a strap hub and strapping positioned in the strap hub. The strap hub comprises a front portion having a contoured front surface, a rear portion having a body angled relative to the front portion, and an arm extending between the front portion and the rear portion. A backrest of the bucket seat comprises an aperture. The arm is disposed through the aperture such that the strap hub is rigidly fixed to the bucket seat and such that the countered front surface of the front portion is substantially flush with the backrest of the bucket seat.

A first shoulder strap is disposed through a first one of two vertically-oriented apertures and a first one of two horizontally-oriented apertures. A second shoulder strap is disposed through a second one of the two vertically-oriented apertures and a second one of the two horizontally-oriented apertures. A crotch strap is disposed through a bottom aperture of the bucket seat. The first shoulder strap, the second shoulder strap, and the crotch strap are detachably attachable to a buckle. At least a portion of the strapping is formed of a silicone material or a fiber-reinforced silicone-coated material. Various characteristics of the foregoing aspects are interchangeable and may be combined with one another.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIGS. 20-23 are various perspective views of a ovular-shaped coupling mechanism of the convertible chair assembly according to various embodiments of the present disclosure.

DETAILED DESCRIPTION

The present disclosure relates to a convertible infant chair assembly that provides enhanced support, stability, configurability, and adjustability to facilitate feeding infants, including babies, toddlers, and the like. The convertible highchair includes a bucket seat with a contoured backrest and an adjustable harness to securely and comfortably hold an infant in place while eating, sitting, playing, or performing various activities. The bucket seat, acting as an infant seat, is also removable to accommodate infants of different sizes and ages. For instance, the bucket seat can be removed to transition the highchair from use as a baby feeding chair to use as a toddler feeding chair, where a toddler seat thereof is height adjustable. The bucket seat of the highchair accommodates a removable tray that is adjustable in distance from the infant to allow for easy access to food and drinks. The tray can also be equipped with a spill-resistant lip to prevent food and drinks from spilling onto the infant's lap or the floor. The highchair also includes a sturdy base with legs that ensure stability on various surfaces.

Figure 1:
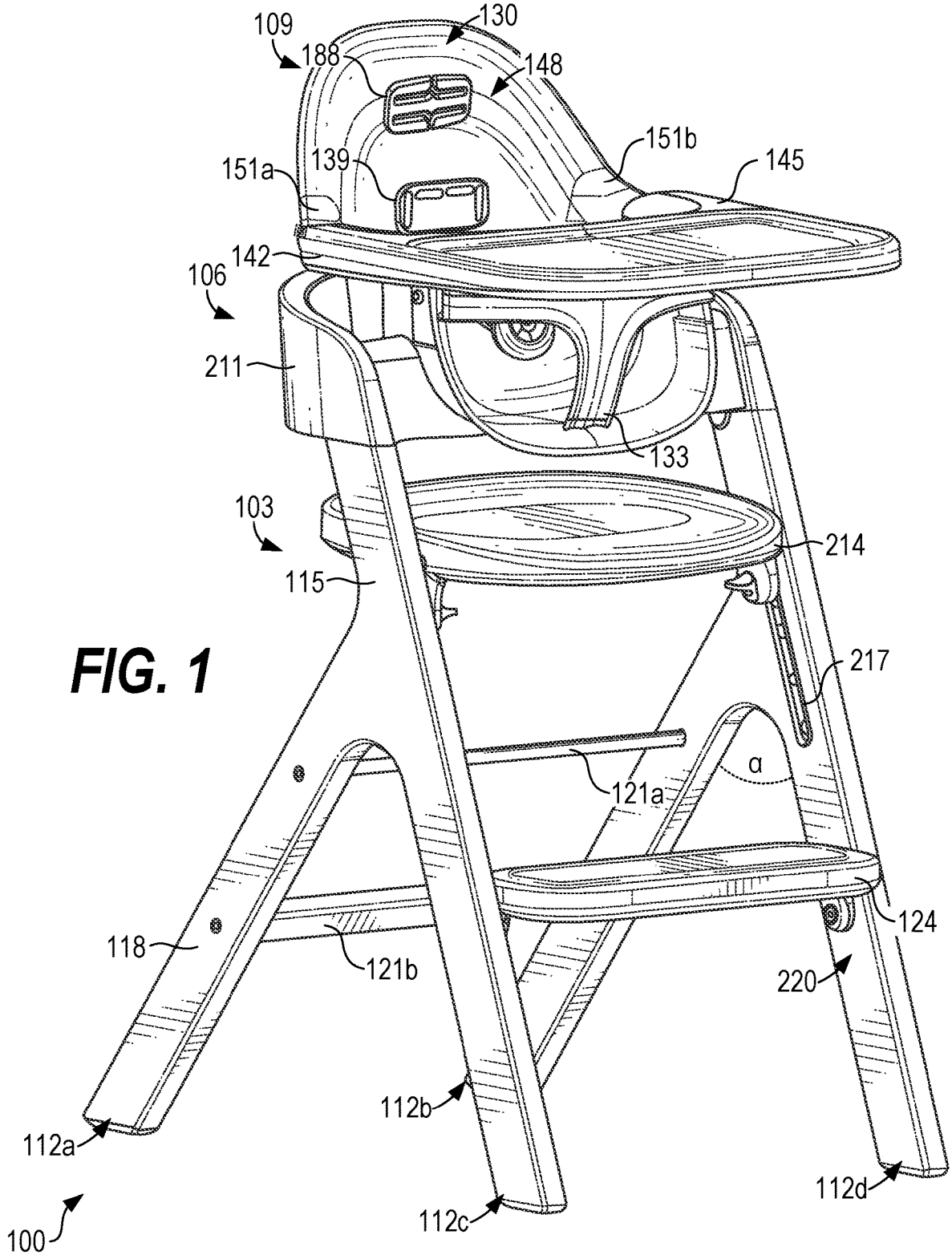
FIG. 1 is a top perspective view of a convertible chair assembly for use as an infant highchair according to various embodiments of the present disclosure.
Figure 2:
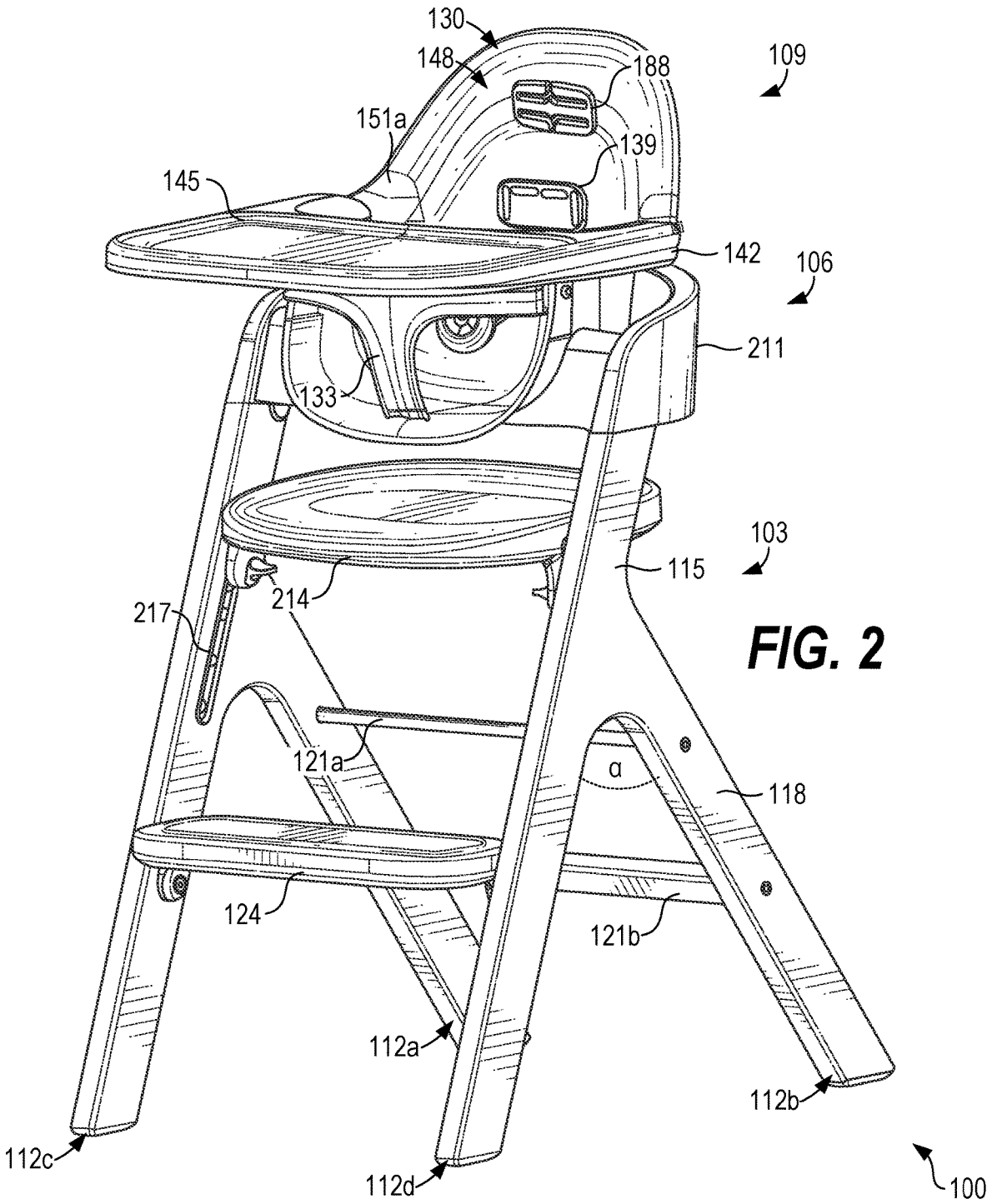
FIG. 2 is another top perspective view of the convertible chair assembly according to various embodiments of the present disclosure.
Figure 3:
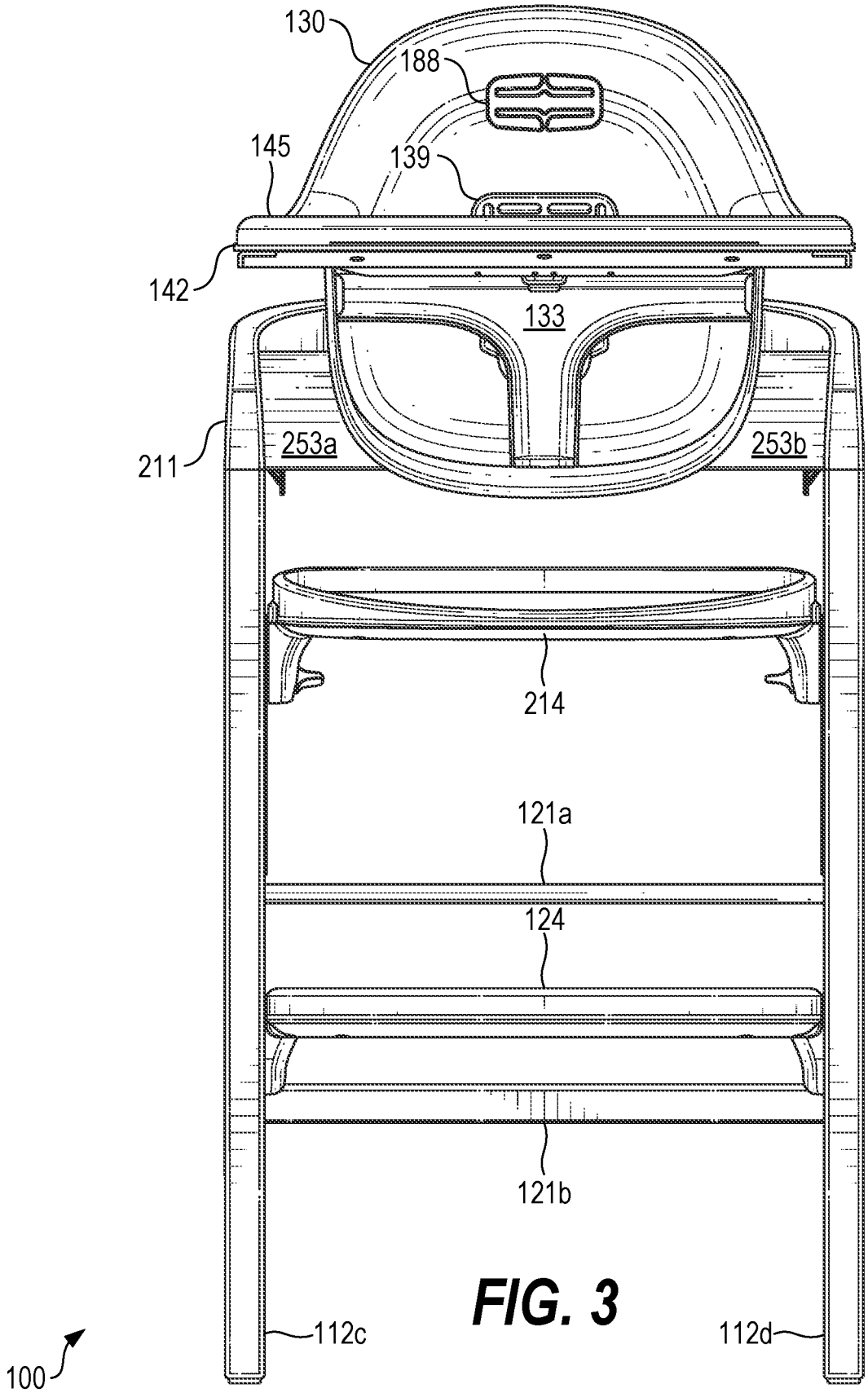
FIG. 3 is a front view of the convertible chair assembly according to various embodiments of the present disclosure.
Figure 4:
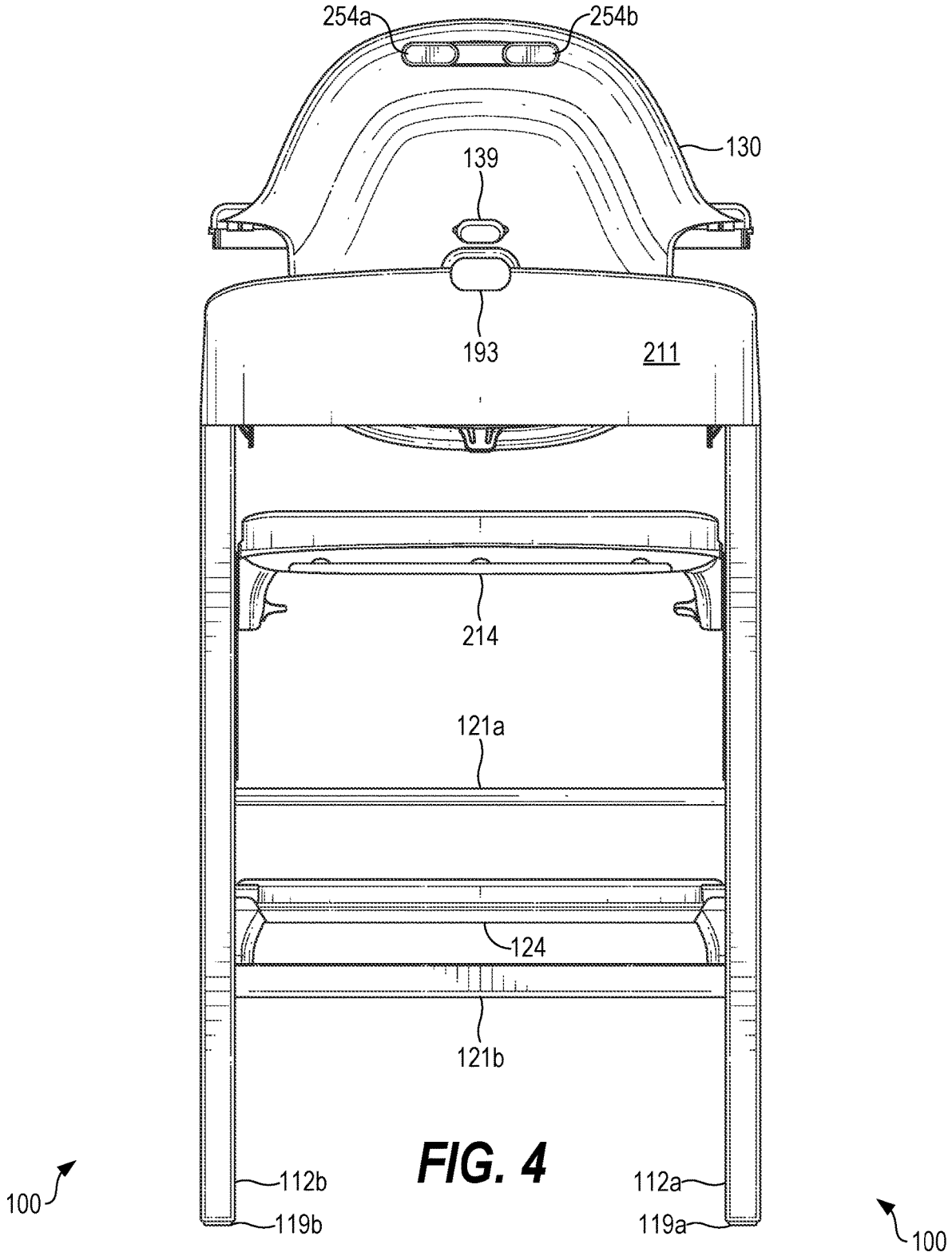
FIG. 4 is a rear view of the convertible chair assembly according to various embodiments of the present disclosure.
Figure 5:
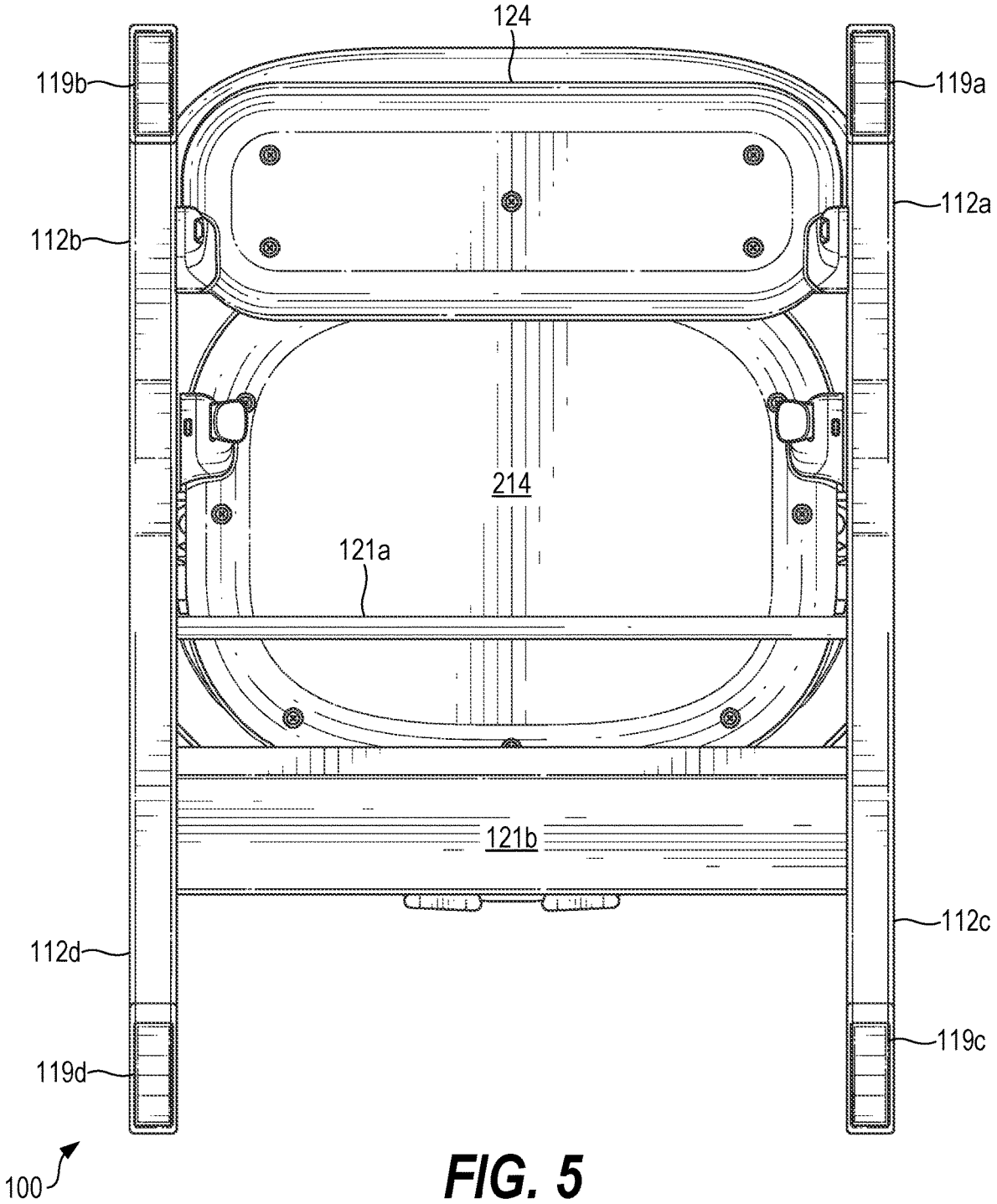
FIG. 5 is a bottom view of the convertible chair assembly according to various embodiments of the present disclosure.
Figure 6:
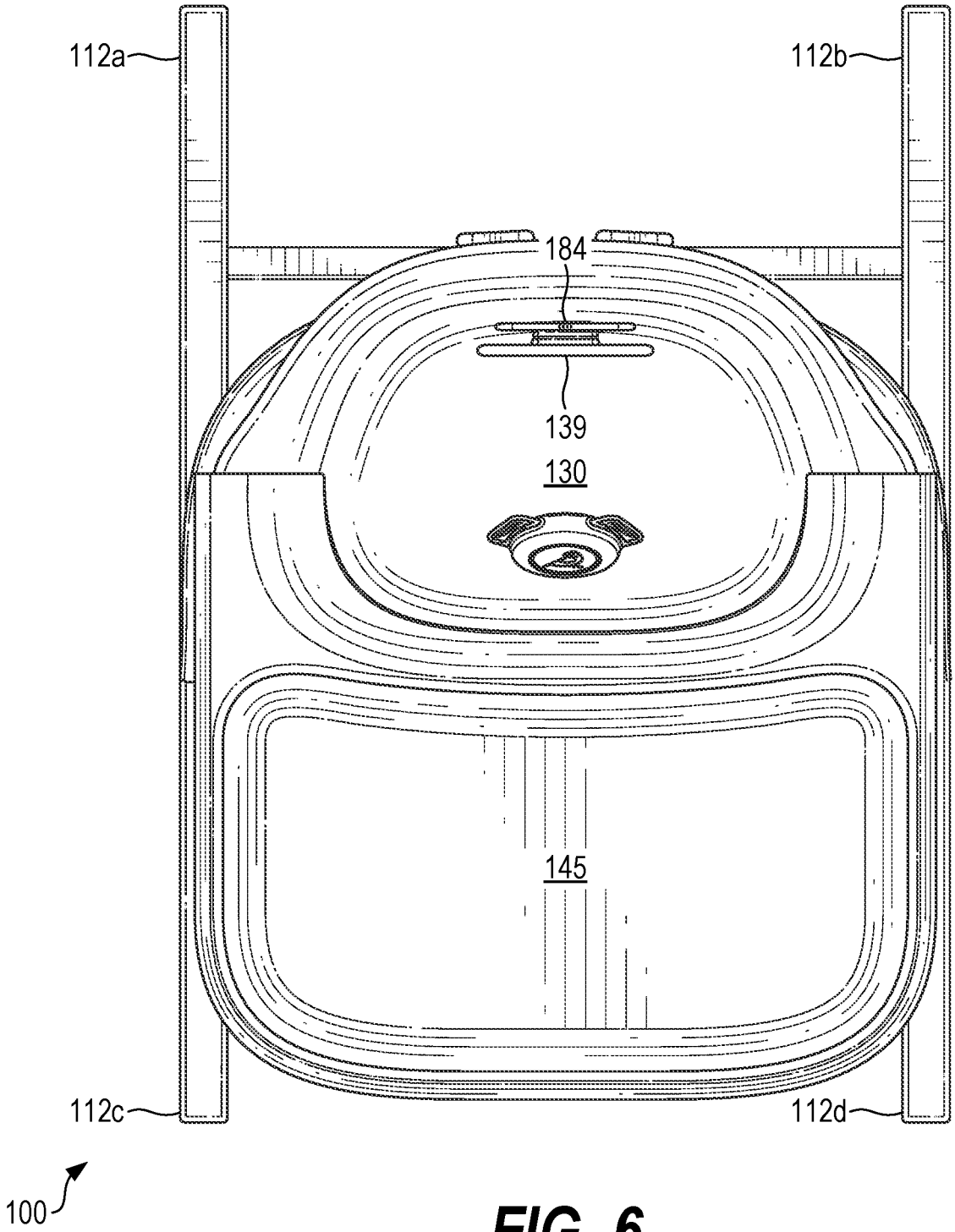
FIG. 6 is a top view of the convertible chair assembly according to various embodiments of the present disclosure.
Figure 7:
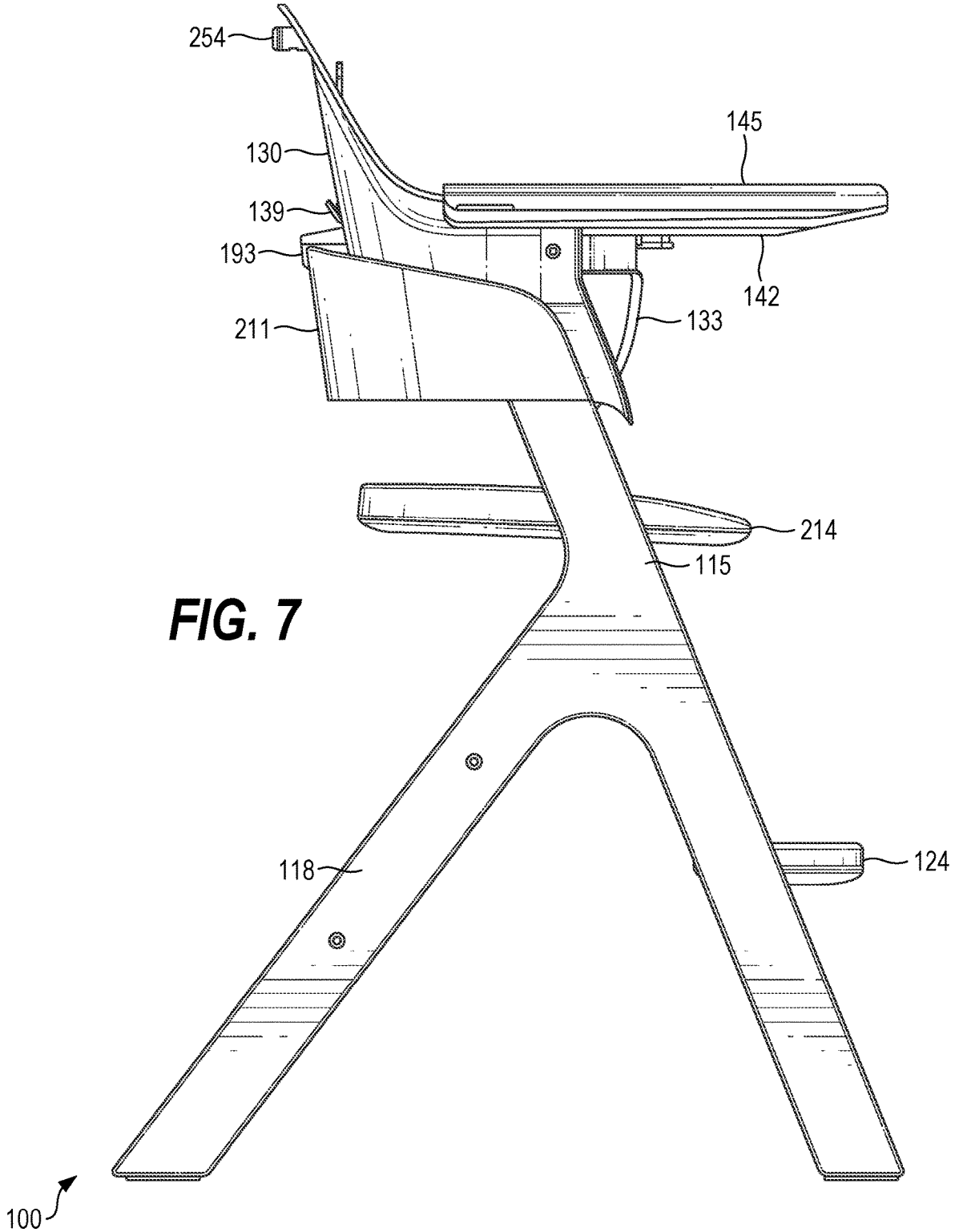
FIG. 7 is a left side view of the convertible chair assembly according to various embodiments of the present disclosure.
Figure 8:
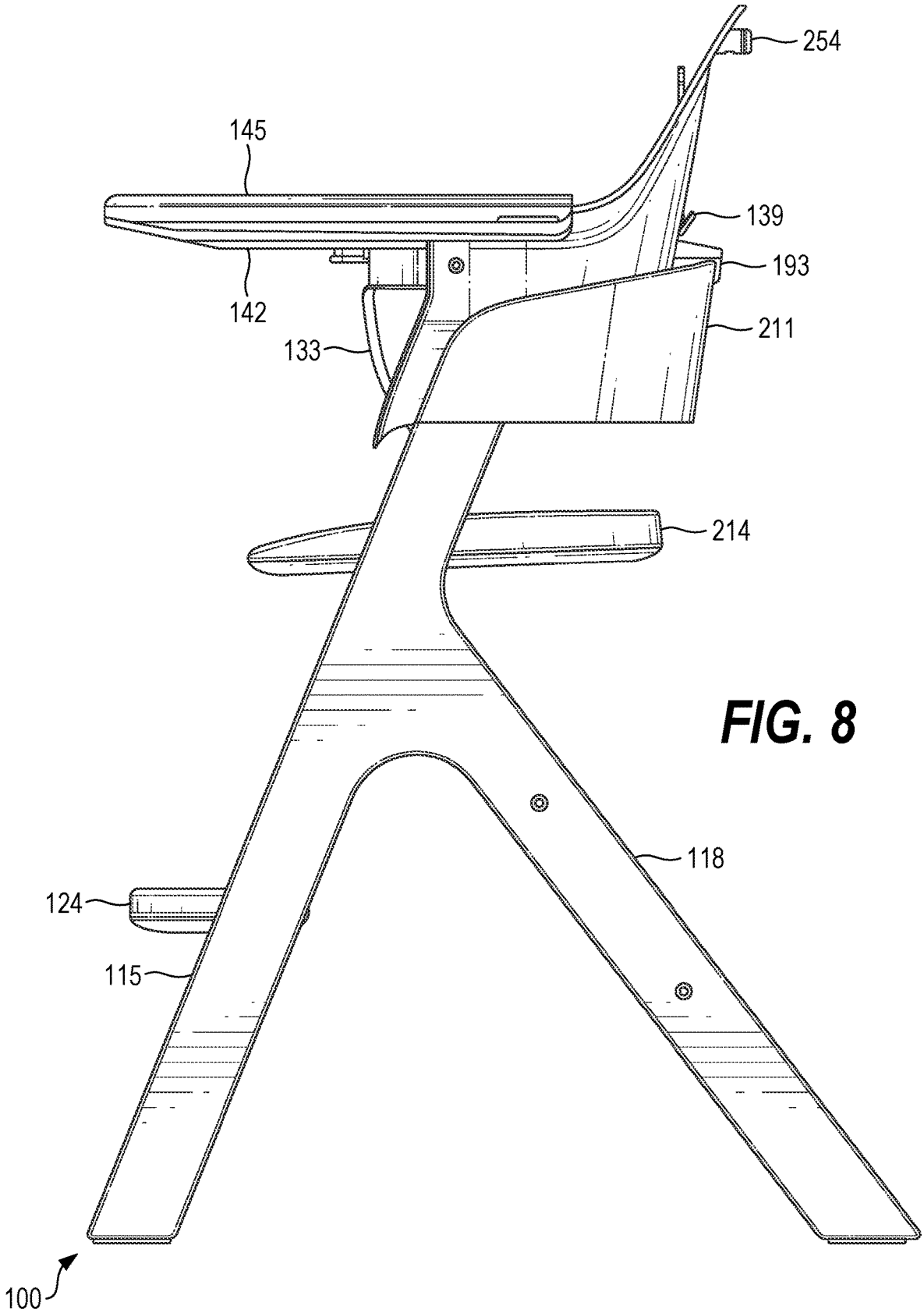
FIG. 8 is a right side view of the convertible chair assembly according to various embodiments of the present disclosure.

Turning now to the figures, various views of a convertible chair assembly 100 are shown according to various embodiments. Specifically, FIGS. 1 and 2 show front perspective views of the convertible chair assembly 100 and FIGS. 3 and 4 show front and rear views of the convertible chair assembly 100, respectively. Moreover, FIGS. 5 and 6 show bottom and top views of the convertible chair assembly 100, respectively, and FIGS. 7 and 8 show alternating side views of the convertible chair assembly 100.

Referring collectively to FIGS. 1-8, the convertible chair assembly 100 can include a support frame 103, a toddler seat assembly 106, and an infant seat assembly 109, among other assemblies, components, and the like as will be described. Generally, the support frame 103 can include a multitude of legs 112*a* . . . 112*d* (collectively "legs 112") that support the toddler seat assembly 106, the infant seat assembly 109, as well as other components as will be described. The support frame 103 can include four legs 112, although it is understood that other suitable number of legs 112 can be implemented.

In various embodiments, as shown in FIGS. 1-8, the legs 112 can be part of a lambda-shaped configuration. For instance, the legs 112 can include an elongated leg member 115 disposed on opposing sides of the support frame 103, where each elongated leg member 115 is positioned at a first angle relative to a ground surface. The elongated leg member 115 can have a height substantially similar to a height of the infant seat assembly 103.

The legs 112 can further include a support leg member 118 positioned at or near a top or central region of the elongated leg member 115. The support leg member 118 can be positioned at a second angle relative to the ground surface, such that the leg 112 has a lambda (2) configuration, an inverted-V configuration, or, in alternative examples, an A-frame configuration having an additional cross-member (not shown) disposed between the elongated leg member 115 and the support leg member 118. The support leg member 118 can be angled and have a length such that a bottom end of the support leg member 118 is positioned behind the toddler seat assembly 106 and the infant seat assembly 109, as can be seen in the side views of FIGS. 7 and 8.

Referring again to FIGS. 1-8 collectively, an angle $\alpha$ between the elongated leg member 115 and the support leg member 118 can be preselected to provide a sturdy and rigid base, thereby ensuring support on various surfaces. In some implementations, the angle $\alpha$ is between 100° and 125°, such as, e.g., 100°, 105°, 110°, 115°, 120°, and 125°, although other angles can be employed without deviating from the scope of the present disclosure. In some embodiments, the legs 112 can have or be coupled to anti-slip pads 119*a* . . . 119*d* (collectively "anti-slip pads 119") coated or otherwise formed of a non-slip material, as can be appreciated.

The support frame 103 can further include one or more cross-members 121*a*, 121*b* (collectively "cross-members 121") that couple opposing sides of the support frame 103 to provide additional support and rigidity, as well as a footrest 124. In some examples, a first cross-member 121*a* couples opposing elongated leg members 115 having a circular cross-section and a second cross-member 121*b* couples opposing support leg members 118 having a square or rectangular cross-section. However, embodiments of the present disclosure are not necessarily limited to these particular examples, and other types and styles of cross-members 121 can be employed.

The footrest 124 can further couple opposing sides of the support frame 103, and can be used in addition to or in place of the cross-members 121 in some configurations. In some embodiments, the footrest 124 can be statically positioned on the support frame 103 such that the position of the footrest 124 is not movable, especially in implementations where a toddler seat is adjustable. However, in some embodiments, the footrest 124 can be adjustable to adjust a distance between the footrest 124 and a toddler seat, as will be described.

Generally, the footrest 124 can have a rectangular body and a planar surface. In some implementations, the footrest 124 can have a contoured surface with rounded corners, which can prevent injury should the surfaces not be rounded or contoured. A first distal end of the footrest 124 can be disposed in an inner recess of the leg 112*c* having a substantially similar cross-section of the footrest 124. Similarly, a second distal end of the footrest 124 can be disposed in an inner recess of the leg 112*d* having a substantially similar cross-section of the footrest 124.

Figure 11A:
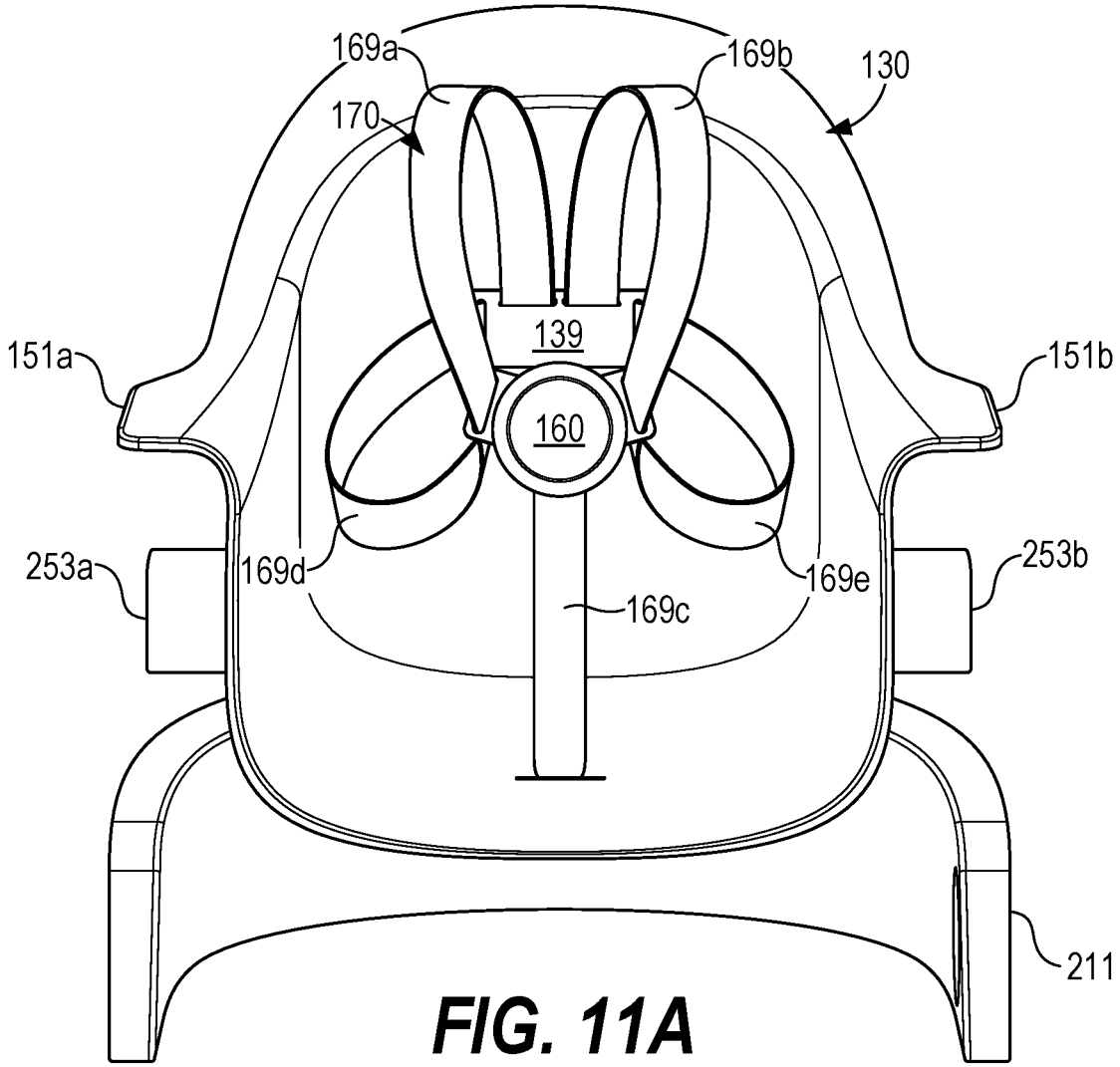
FIGS. 11A-11C are front and perspective views, respectively, of a harness assembly of the convertible chair assembly according to various embodiments of the present disclosure.

Turning now to the infant seat assembly 109, the infant seat assembly 109 can include a bucket seat 130, a crotch post 133, a strap hub 139, a tray 142, and a tray liner 145 in various embodiments. Generally, the bucket seat 130 can be ergonomically contoured to support an infant. To this end, in some embodiments, the bucket seat 130 can include a rounded backrest 148, which further assists in retaining the infant in the bucket seat 130. The bucket seat 130 can further include arm rests 151*a*, 151*b* (collectively "arm rests 151") disposed on opposing sides of the bucket seat 130, as best shown in FIG. 11A. The arm rests 151 can be integral with the rounded backrest 148 and thus can be formed of the same material through molding, additive manufacturing, or like processes.

The crotch post 133 can include a T-configuration having horizontally-extending top members 154*a*, 154*b* (see FIG. 13, collectively "top members 154) coupled to a vertically-extending central member 157 positioned orthogonal to the top members 154*a*, 154*b*. The top members 154 and the central member 157 can be integral with one another and, thus, can be a single piece. As can be appreciated, the top members 154 and the central member 157 together define leg apertures where legs of the infant can be positioned through the leg apertures such that infant legs are disposed on opposing sides of the central member 157.

A buckle clip 162 or other suitable connection mechanism (e.g., strap projection) can be employed to detachably attach the central member 157 to the bucket seat 130 or other suitable portion of the infant seat assembly 109. For instance, the buckle clip 162 can detachably attach to a buckle aperture 163 positioned, for example, in a forward, bottom portion of the bucket seat 130. Similarly, screws 166, buckles, projections, bar tacks, and other suitable connection mechanisms can be employed to detachably attach the top members 154 to the bucket seat 130 or other suitable portion of the infant seat assembly 109.

Figure 9:
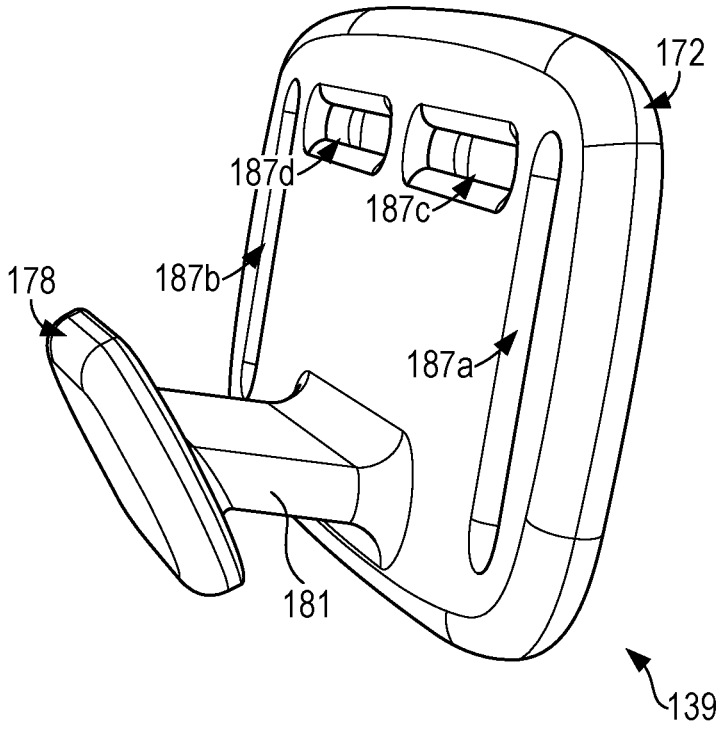
FIG. 9 is a rear perspective view of a strap hub of the convertible chair assembly according to various embodiments of the present disclosure.
Figure 10:
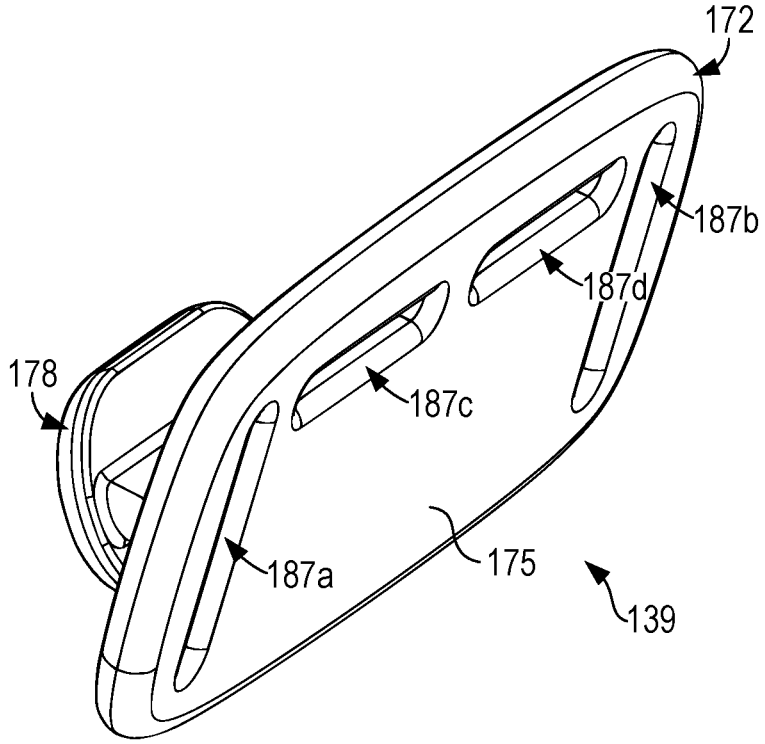
FIG. 10 is a front perspective view of the strap hub of the convertible chair assembly according to various embodiments of the present disclosure.
Figure 13:
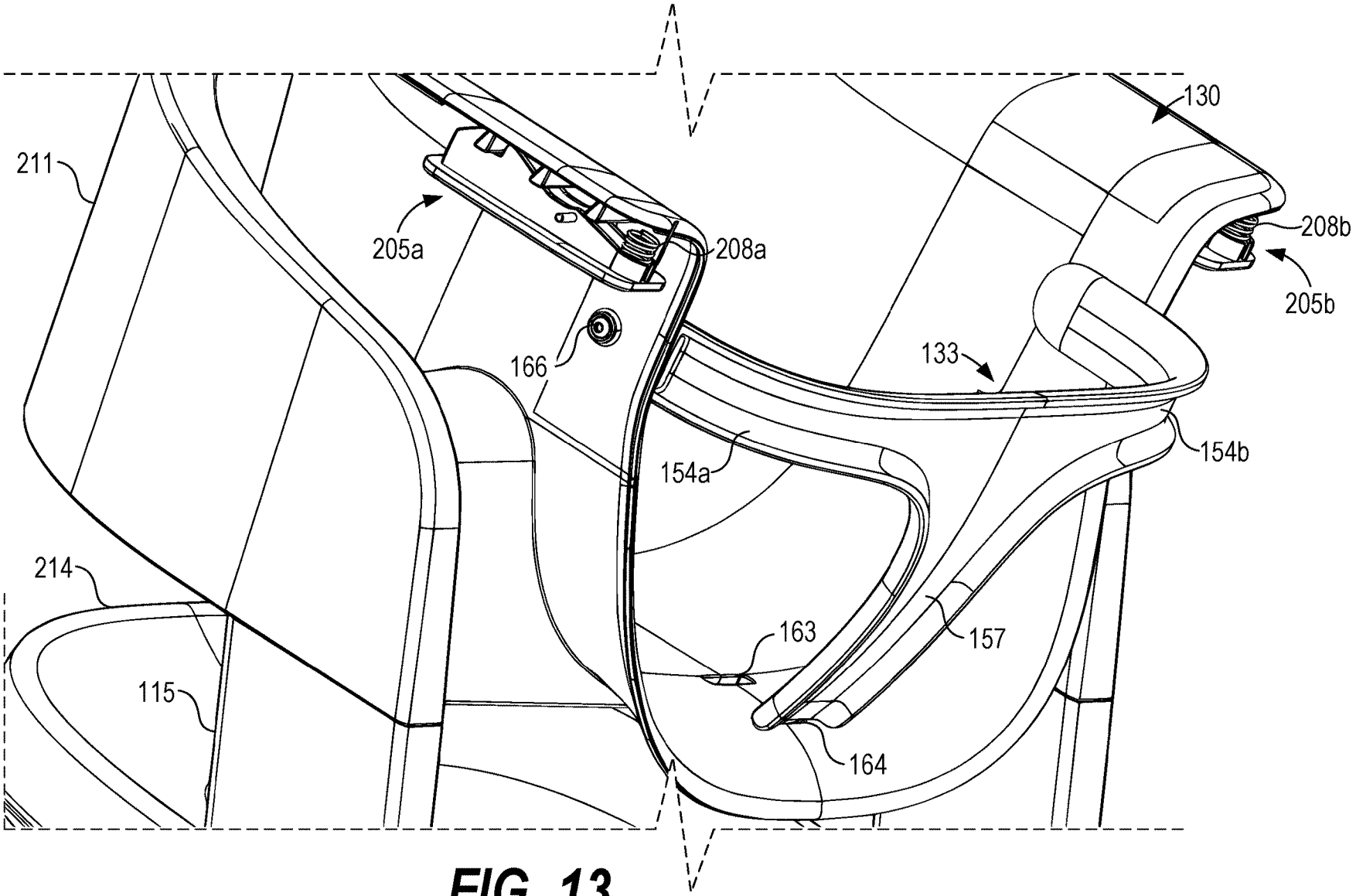
FIG. 13 is an enlarged front view of the convertible chair assembly according to various embodiments of the present disclosure.

The strap hub 139, also shown isolated in FIGS. 9 and 10, can be configured to retain and secure strapping 169 of a harness assembly 170 to the bucket seat 130 where the strapping 169, the strap hub 139, and/or the crotch post 133 collectively restrain the infant in the bucket seat 130. The strap hub 139 can be positioned at the contoured backrest 148 of the bucket seat 130 in some embodiments. The strap hub 139 can be formed of a polymer material in some embodiments, such as silicone. As shown in FIG. 13, the central member 157 of the crotch post 133 can be positioned and engaged with a crotch post aperture 164.

As best shown in the perspective views of the strap hub 139 of FIGS. 9 and 10, the strap hub 139 can include a front portion 172 having a contoured front surface 175, a rear portion 178 having a body angled relative to the front portion 172, and a connecting arm 181 extending between the front portion 172 and the rear portion 178. As the backrest 148 of the seat assembly can include an aperture 184 in some implementations, the connecting arm 181 can be disposed through the aperture 184 such that the strap hub 139 can be fixed (e.g., rigidly or removably fixed) or positioned in proximity to the bucket seat 130 and such that the countered front surface 175 of the front portion 172 of the strap hub 139 is flush or substantially flush with the backrest 148 of the bucket seat 130.

In some embodiments, the front portion 172 is detachably attachable to the connecting arm 181 and/or the rear portion 178 is detachably attachable to the connecting arm 181, which may facilitate placement of the strap hub 139 through the aperture 184 through removal and replacement of one or more of the front portion 172 and the rear portion 178.

Figure 12:
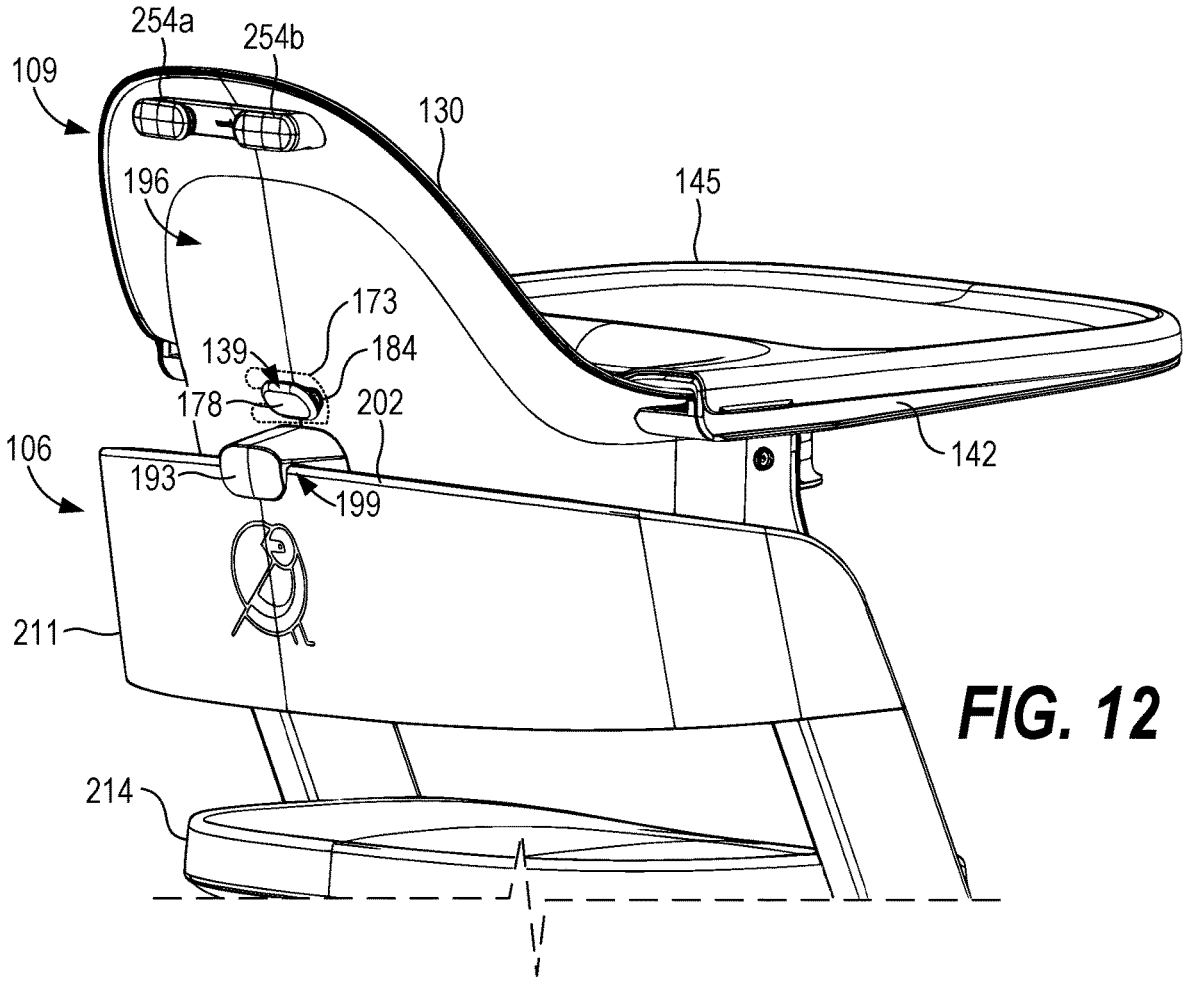
FIG. 12 is an enlarged rear view of the convertible chair assembly according to various embodiments of the present disclosure.

In some embodiments, as shown in FIG. 12, a security clip 173 may be provided that retains the rear portion 178 of the strap hub 139 in the infant seat, for instance, when a significant force is applied to the front side of the strap hub 139 which could potentially dislodge the strap hub 139 from the infant seat. The security clip 173 can include a notch that permits the connecting arm 181 to slide therebetween, such that the security clip 173 nests between the rear portion 178 of the strap hub 139 and the rear end 196 of the bucket seat 130. The security clip 173 thus provides addition surface area, which increases an amount of force required to dislodge the rear portion 178 from the aperture 184.

Additionally, the front portion 172 of the strap hub 139 can include a multitude of apertures 187. For instance, the strap hub 139 can include two vertically-oriented apertures 187*a*, 187*b* (collectively "vertically-oriented apertures 187") and two horizontally-oriented apertures 187*c*, 187*d* (collectively "horizontally-oriented apertures 187") disposed on first and second ends of the front portion 172. The horizontally-oriented apertures 187 are positioned between the vertically-oriented apertures 187 where tops of all apertures 187 are substantially aligned.

Figure 11B:
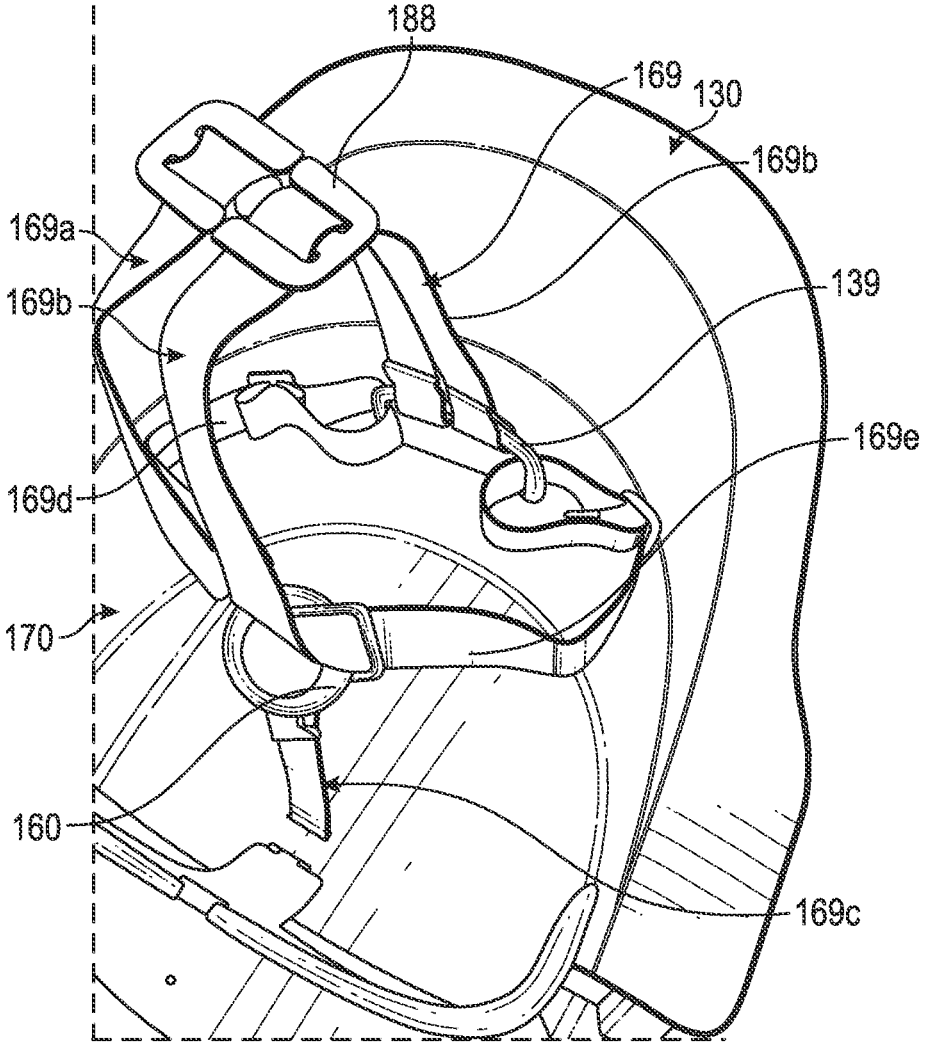

FIGS. 11A and 11B show a harness assembly 170 that includes the strapping 169 that can be employed with the convertible chair assembly 100. The strapping 169 of the harness assembly 170 can include a first shoulder strap 169*a* having ends disposed through a first vertically-oriented aperture 187*a* and a first horizontally-oriented aperture 187*c*. The strapping 169 can further include a second shoulder strap 169*b* having ends disposed through a second vertically-oriented aperture 187*b* and a second horizontally-oriented aperture 187*d*.

In some implementations, the strapping 169 can provide an alternative crotch strap 169*c* disposed through a bottom aperture of the bucket seat 130. A buckle 160 can be provided in some implementations, where the first shoulder strap 169*a* and the second shoulder strap 169*b* can be detachably attachable to the buckle 160 via a male projection, bar tack, or like connection. The buckle 160 shown in FIG. 11A includes a Y-configuration or a three-point buckle, however, it is understood that other types of buckles 160 can be employed. For instance, two-point buckles, four-point buckles, five-point buckles, and so forth can be implemented based on corresponding adjustments to the strapping 169 and components thereof. The crotch strap 169*c* can be fixedly attached to the buckle 160, for instance, through a sewn connection, although other types of fixed connections can be employed.

In some embodiments, at least a portion of the strapping 169 can be formed of a fiber-reinforced polymer-coated material. The underlying material may or may not be woven and formed through depositing a polymer material (e.g., silicone), through extrusion or molding the polymer onto fibers or like structure, which, when cured, yields a flexible strapping material. Implementation of such coated material can provide enhanced performance as opposed to woven materials alone, particularly with respect to cleanability, as the polymer coating is easily wiped clean and does not absorb food or other contaminants. The particular arrangement of the apertures 187 on the strap hub 139 facilitate use of the strapping 169 formed of the fiber-reinforced polymer-coated material.

Thus, various embodiments of the convertible chair assembly 100 include a harness assembly 170 that is secured to the bucket seat 130 without the harness assembly 170 or the strapping 169 thereof having passed through or secured to a backside of the bucket seat 130. The harness assembly 170 thus includes shoulder straps 169*a*, 169*b*, waist straps, and a crotch strap 169*c*, and can further include a strap minder 188, as will be described. The crotch strap 169*c* can be secured to the front portion of the seating surface of the infant seat 130. The harness assembly 170 can further include the buckle 160. The first shoulder strap 169*a* and the second shoulder strap 169*b* are detachably attachable to the buckle 160, and similarly waist straps 169*d*, 169*e* are detachably attachable to the buckle 160. The harness straps, including at least one of the shoulder straps 169*a*, 169*b*, the waist straps 169*d*, 169*e*, and the crotch strap 169*c* of the harness assembly 170 are formed, at least in part, of a fiber-reinforced, silicone coated material. As best shown in FIG. 11B, generally, the harness assembly 170 can be secured to a front side of the backrest 148 of the bucket seat 130, without having passed through or without having been secured to a rear side of the bucket seat 130.

Figure 11C:
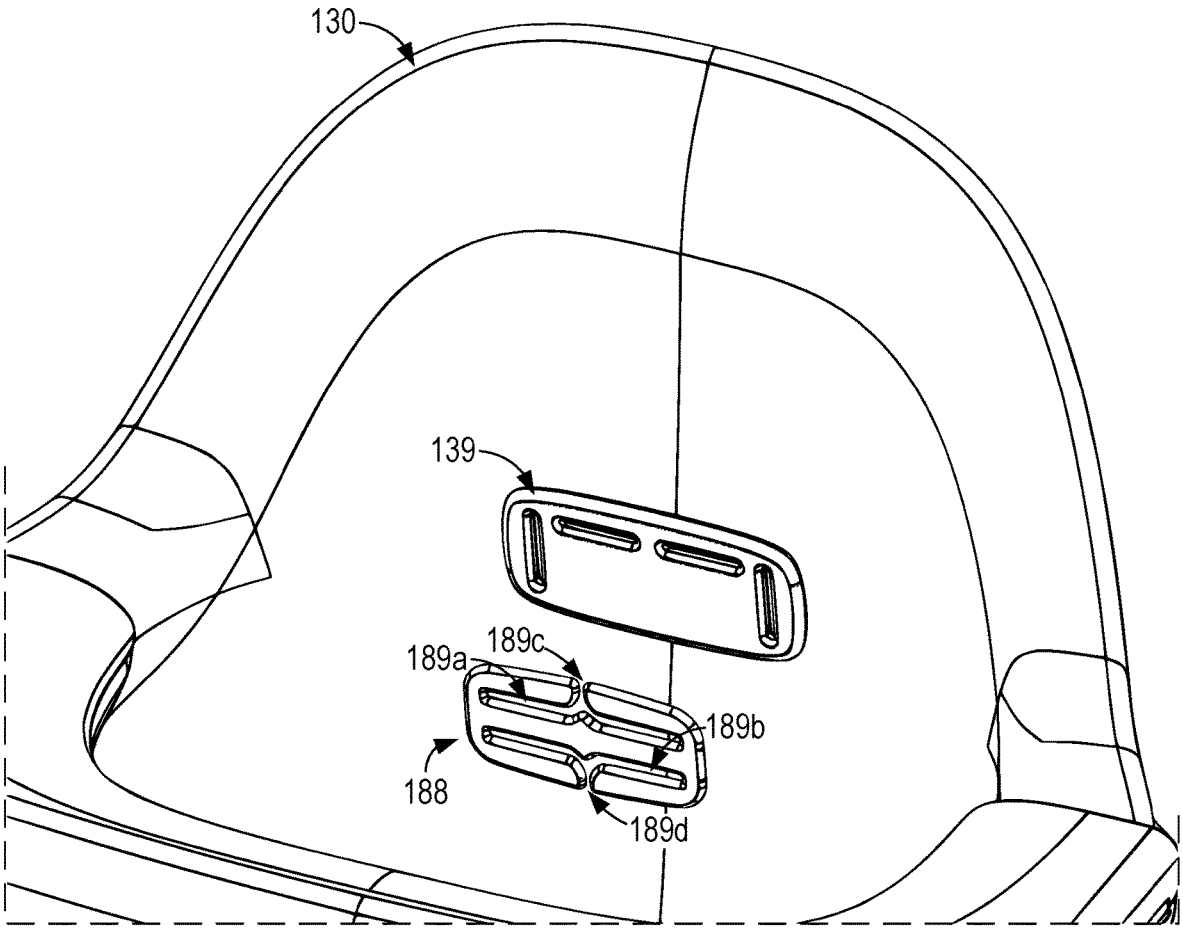

Referring now to FIG. 11C, the strap hub 139 is shown relative to the strap minder 188, where the strap minder 188 can be used to further facilitate orientation and placement of the strapping 169 of the harness assembly 170. The strap minder 188 can include an integral body formed of a polymer material, such as silicone. The integral body of the strap minder 188 can include an elongated top aperture 189*a*, an elongated bottom aperture 189*b*, and flex apertures 189*c*, 189*d*. As such, the strap minder 188 can be positioned on a chest or other suitable area of an infant, where the strapping 169 is looped through ends of a top aperture and a bottom aperture. For instance, the first shoulder strap 169*a* can be looped through a first side of the elongated top aperture 189*a* and a first side of the elongated bottom aperture 189*b*. Similarly, the first shoulder strap 169*b* can be looped through a second (opposite) side of the elongated top aperture 189*a* and a second (opposite) side of the elongated bottom aperture 189*b*. A position of the strap minder 188 can be oriented by pulling upwards or downwards by virtue of the size and geometric configuration of the strap minder 188 relative to the strapping 169.

Referring back to FIG. 12, as best shown in the enlarged, rear perspective view of FIG. 12, the bucket seat 130 can further include a rear support 193 projecting from a rear end 196 of the bucket seat 130. The rear support 193 provides an additional point of contact, providing additional security and retention of the bucket seat 130 relative to the toddler seat assembly 106 and the infant seat assembly 109. Thus, in some embodiments, the rear support 193 can include a downward facing hook 199 that engages a surface 202 of the back of the bucket seat 130. It is understood that other connections between the rear support 193 and the toddler seat assembly 106 can be employed to provide support at a rear of the convertible chair assembly 100.

Referring back to FIGS. 1-8, the tray 142 can include a generally planar surface that is cantilevered to the bucket seat 130. The tray 142 can include geometry or contours, to serve as dividers that separates dishware or food placed within them. In some embodiments, the tray 142 is horizontally-adjustable relative to the bucket seat 130. In other words, the distance between the tray 142 and an infant can be adjusted fore and aft. To this end, the infant seat assembly 109 can include tray supports 205*a*, 205*b* (collectively "tray supports 205"), which are shown in FIG. 13.

In some implementations, the tray supports 205 are nested below the arm rests 151 and provide an area in which a projecting portion of the tray 142 nests. The tray supports 205 provide an area in which a portion of the tray 142 can be slid, such that the tray 142 is cantilevered to the bucket seat 130. The tray supports 205, in some embodiments, can be spring-loaded. To this end, springs 208*a*, 208*b* (collectively "springs 208") of the tray supports 205 can be provided and biased to facilitate horizontal movement and removal of the tray 142, thereby minimizing an amount of effort required to adjust or remove the tray 142 from the bucket seat 130. The tray liner 145 can include a bottom surface that corresponds to a top surface of the tray 142. The tray liner 145 can be coupled to the tray 142 via a snap connection, interference fit, friction fit, or like connection.

In some embodiments, the bucket seat 130 is removable from the support frame 103 and/or the toddler seat assembly 106. A perspective view of the convertible chair assembly 100 is shown having the bucket seat 130 removed for explanatory purposes. Notably, the toddler seat assembly 106 includes a toddler seat backrest 211 and a toddler seat 214. The toddler seat backrest 211 can be ergonomically contoured and thus can include a U-shaped, C-shaped, and/or semi-circular-shaped body in various embodiments. As such, when the bucket seat 130 is removed, a toddler can sit on the toddler seat 214 and rest against the backrest 211. The footrest 124 can be further used in this particular configuration. As can be appreciated, the toddler seat backrest 211 is separate from the backrest 148 of the bucket seat 130. Although not shown in FIG. 14, it is understood that the harness assembly 170 can be employed in the configuration shown in FIG. 14.

The legs 112 of the support frame 103 can include toddler seat tracks 217 disposed on inner surfaces 220 of the opposing legs 112 or, more specifically, the elongated leg members 115. The toddler seat 214 can thus have a variable height such that the toddler seat 214 is adjustable relative to the backrest 211 of the toddler seat assembly 106 via the toddler seat tracks 217, as will be described.

Figure 15:
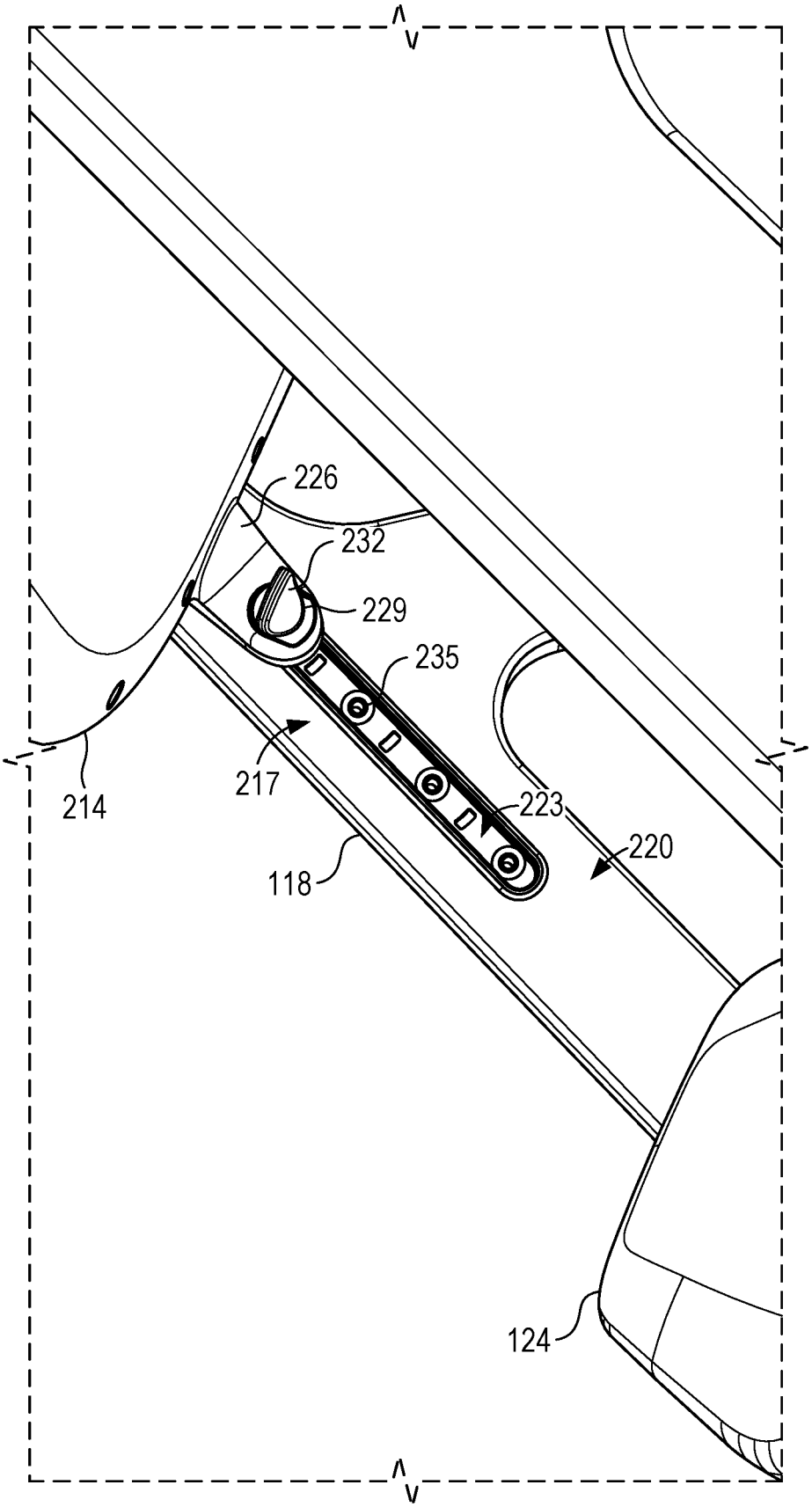
FIG. 15 is an enlarged view of the convertible chair assembly showing a toddler seat track according to various embodiments of the present disclosure.
Figure 16:
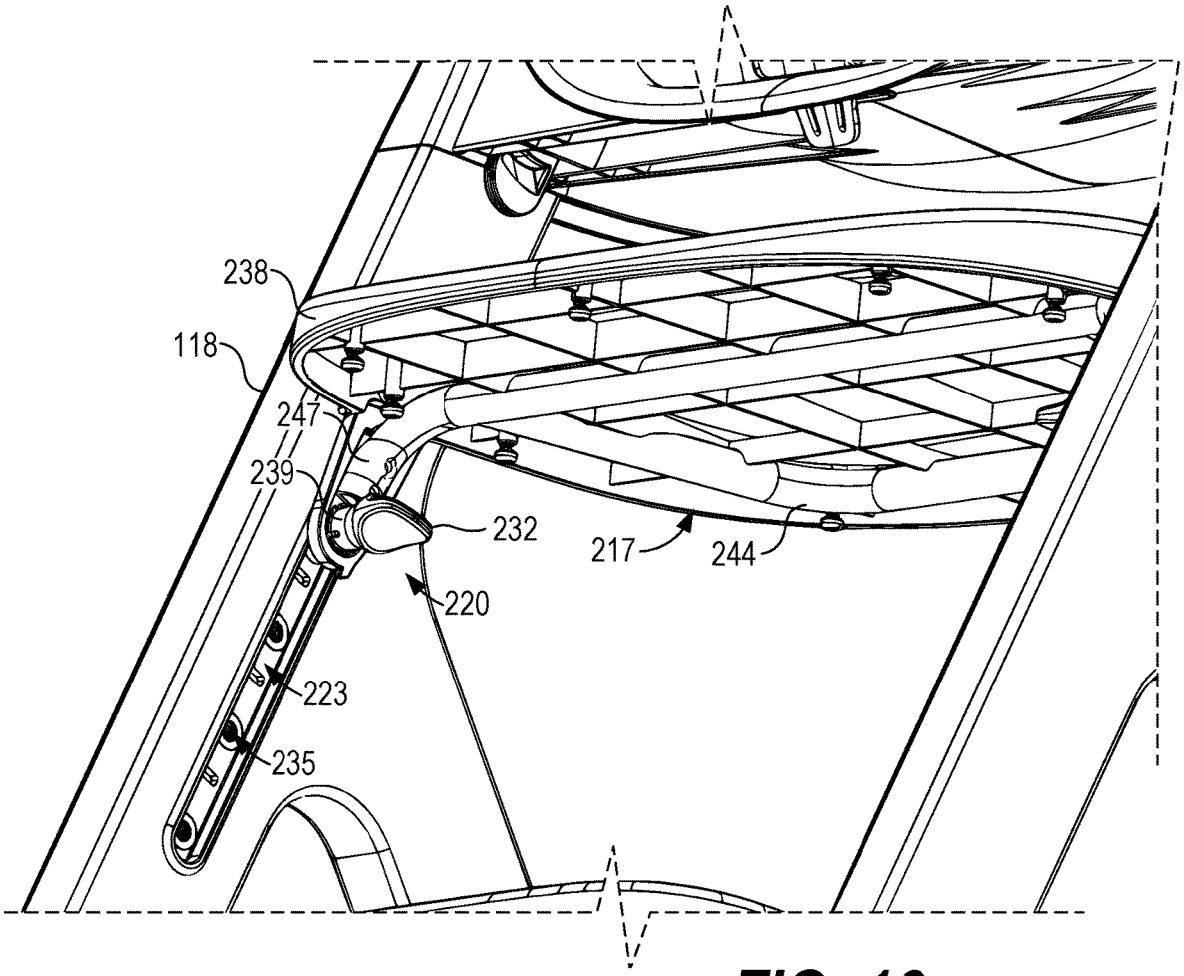
FIG. 16 is another enlarged view of the convertible chair assembly showing the toddler seat track according to various embodiments of the present disclosure.

Enlarged views of a representative one of the toddler seat tracks 217 are shown in FIG. 15 and FIG. 16, where a bottom portion of the toddler seat 214 is hidden in FIG. 16 for explanatory purposes. The toddler seat track 217 is again shown on the inner surface 220 of one of the elongated leg members 115. The toddler seat track 217 can include a raceway 223, which can include an elongated recessed region, disposed in the inner surface 220. The raceway 223 can be rectangular with rounded edges in some embodiments. It is understood, however, that other shaped raceway 223 can be employed.

A coupling mechanism 226 can be integral with or coupled to a bottom surface of the toddler seat 214. For instance, the coupling mechanism 226 can include an integral portion of the toddler seat 214 that projects downward. The coupling mechanism 226 includes an aperture 229. A threaded pull knob 232 can be positioned through the aperture 229 to mate the coupling mechanism 226 to the inner surface 220 and/or to the raceway 223. The threaded pull knob 232 can be twisted and then pulled using two fingers, for example, which causes a rod 239 (FIG. 16) to threadedly decouple from one of a multitude of apertures or slots 235 nested in the raceway 223 without being wholly removed from the aperture 229 of the coupling mechanism 226. While a threaded pull knob 232 is described, in other implementations, a non-threaded pull knob could be employed with a slot 235 having no threads disposed therein. It is understood that other types of connection mechanisms can be employed.

In some embodiments, the coupling mechanism 226 includes an aperture or slot 235, a compression spring (not shown), and a threaded shaft, terminating in a knob 232, which is positioned through the aperture 235 that mates the coupling mechanism 226 to adjacent tracks of the legs 112 of the support frame 103. The threaded shaft, including the knob 232 can be turned, clockwise or counterclockwise, thereby causing the toddler seat to couple or decouple from the raceways located in the legs 112. Upon decoupling, the threaded shaft and/or the compression spring pushes the knob 232 outward to direct full release of the coupling mechanism 226.

By virtue of movement of the threaded pull knobs 232, the toddler seat 214 can be vertically adjusted, for instance, with respect to a ground surface or with respect to the toddler seat backrest 211. While the legs 112 can be formed of wood, plastic, or other material, the raceway 223 can be formed of a same or different material if such material is sufficient for facilitating substantially vertical movement of the toddler seat 214.

Figure 17:
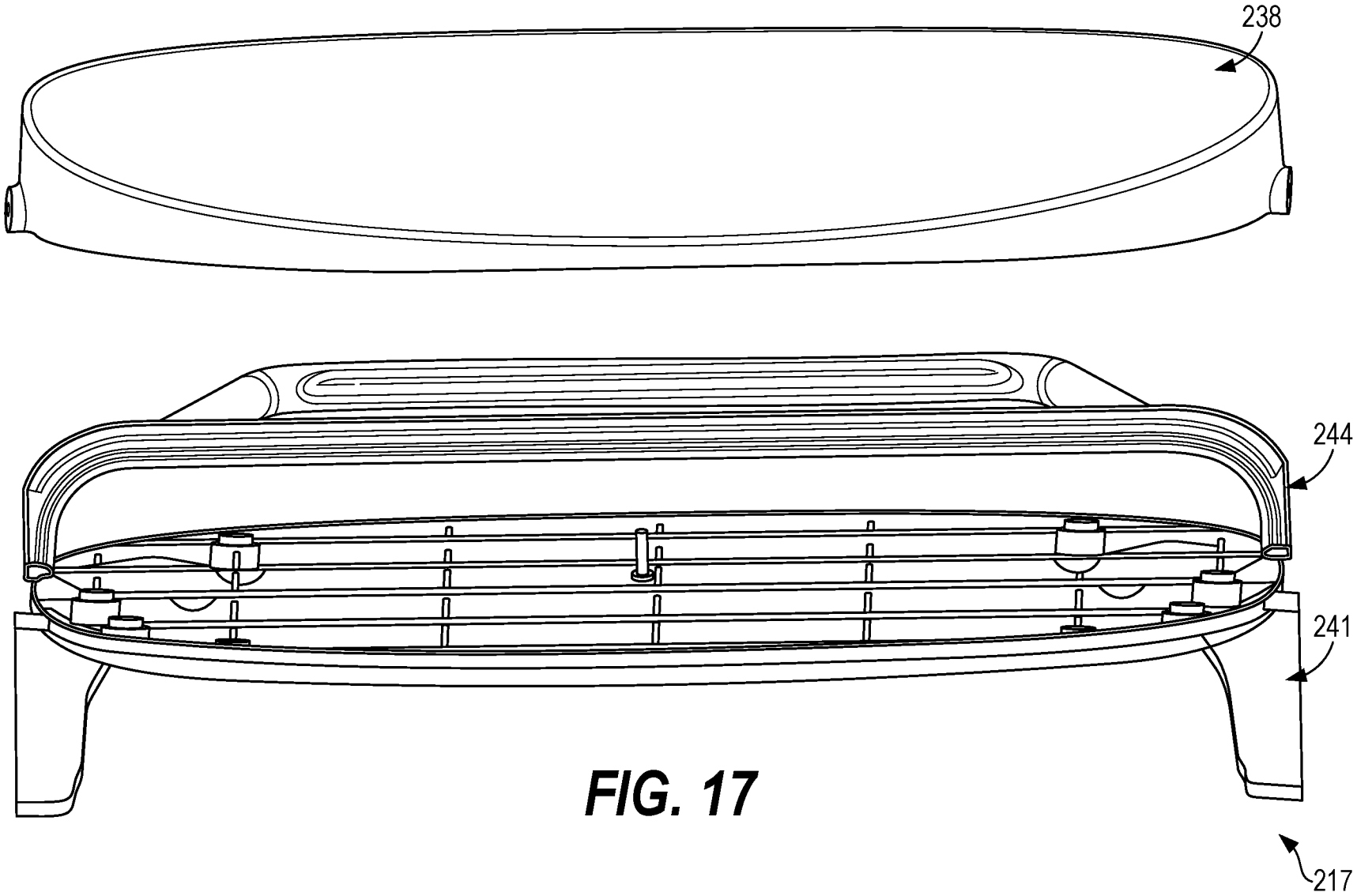
FIG. 17 is an exploded view of a toddler seat of the convertible chair assembly according to various embodiments of the present disclosure.

As shown in FIG. 16 and the exploded view of the toddler seat 214 shown in FIG. 17, the toddler seat 214 can be composed of a top portion 238, a bottom portion 241, and a support structure 244 that is disposed between the top portion 238 and the bottom portion 241. For instance, the top portion 238 and the bottom portion 241 can be detachably attached to one another using a multitude of corresponding projections and apertures, which sandwiches the support structure 244 therein. The support structure 244 can include tubular metal or other rigid material that is disposed at rear and front portions of the toddler seat 214, providing support. The support structure 244 can include ends 247 that bend and nest within the coupling mechanisms 226, where the coupling mechanisms 226 project downwards from the bottom of the toddler seat 214, as described above. The support structure 244 thus can be formed of stainless steel, steel, or other tubular material. Other materials and shapes of the support structure 244 can be employed.

Figure 18:
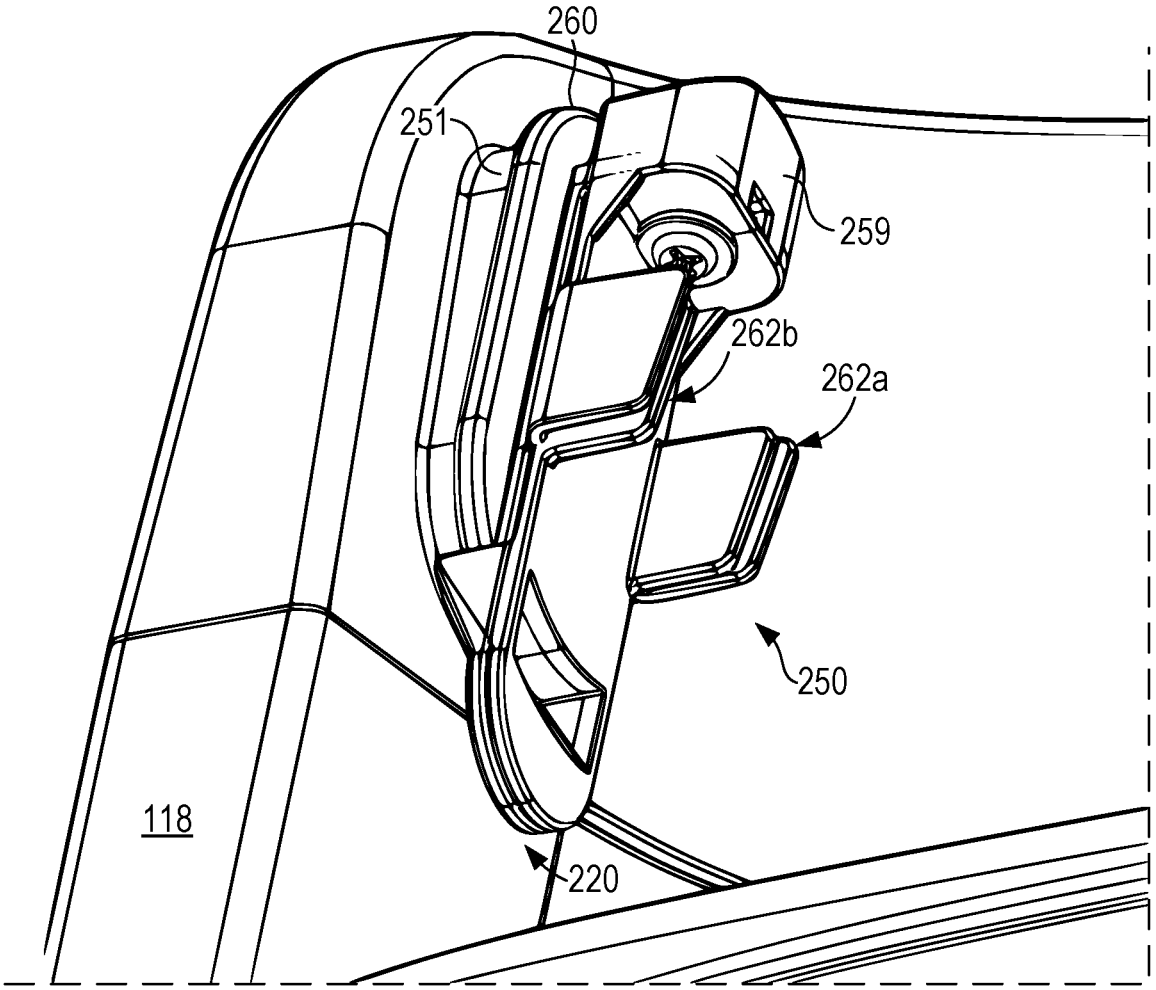
FIG. 18 is an enlarged perspective view of a bucket seat connector of the convertible chair assembly according to various embodiments of the present disclosure.
Figure 19:
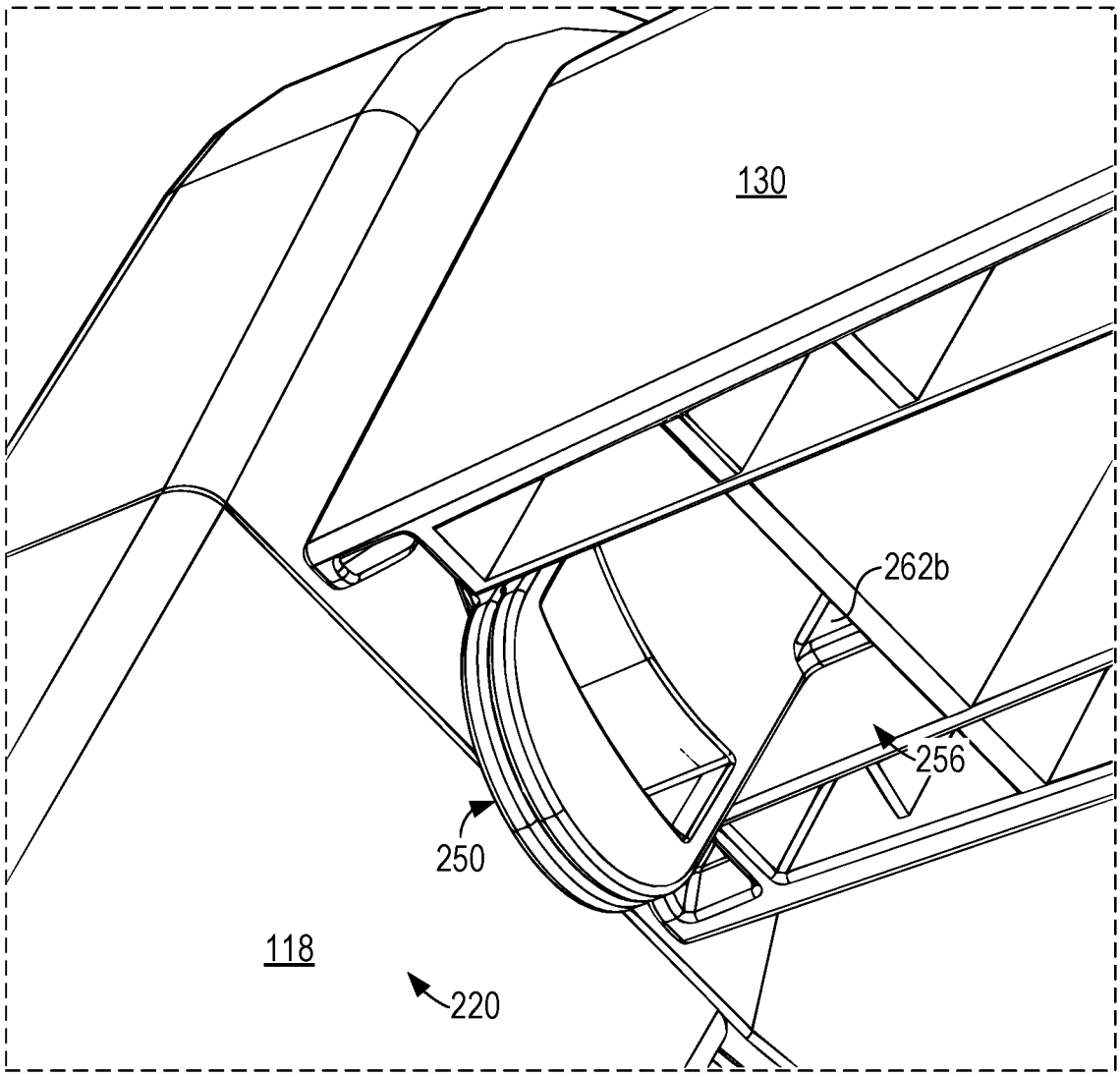
FIG. 19 is another enlarged perspective view of the bucket seat connector of the convertible chair assembly according to various embodiments of the present disclosure.
Figure 24:
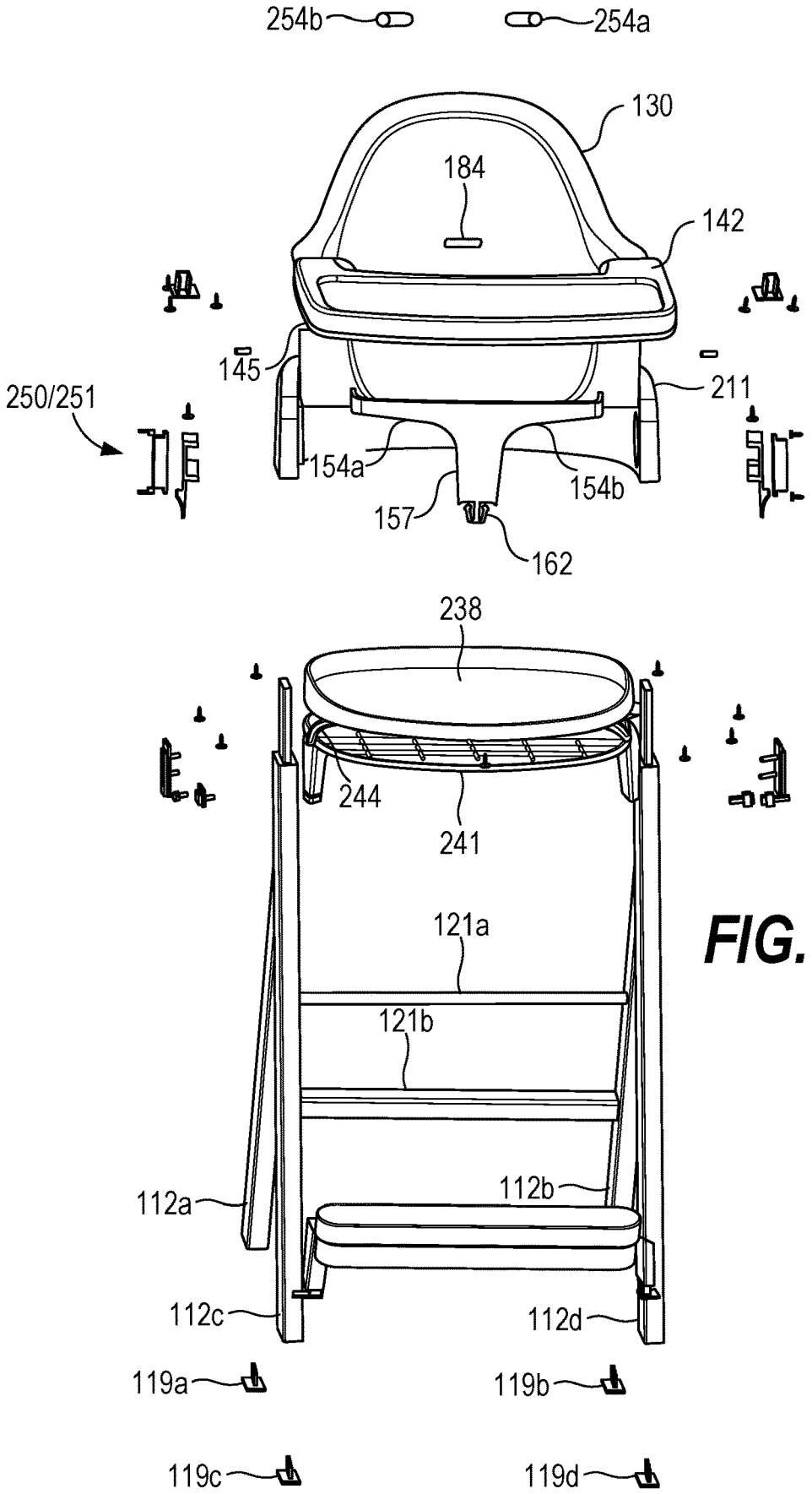
FIG. 24 is an exploded view of the convertible chair assembly according to various embodiments of the present disclosure.
Figure 25:
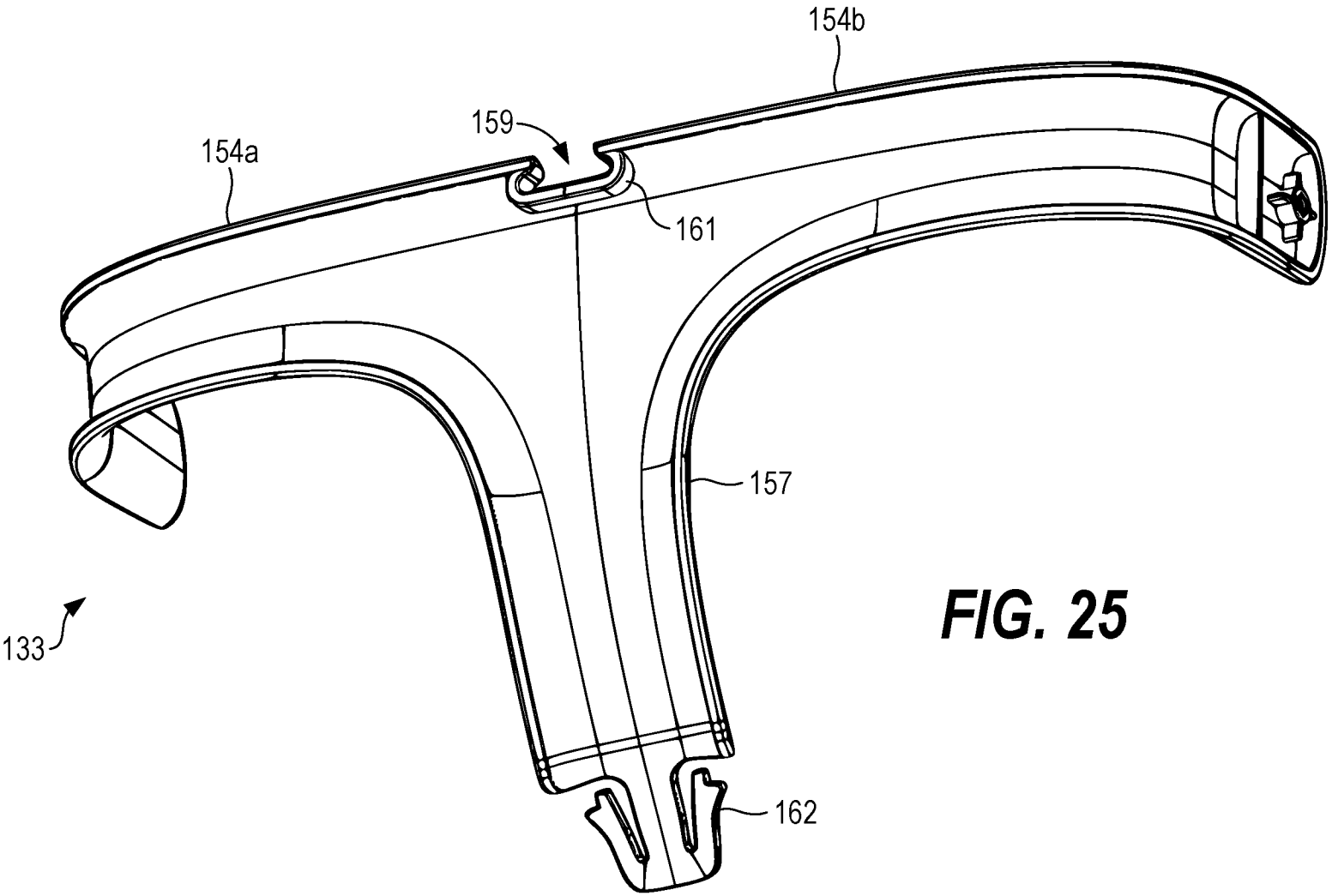
FIG. 25 is a perspective view of a strap minder of the convertible chair assembly according to various embodiments of the present disclosure.
Figure 26:
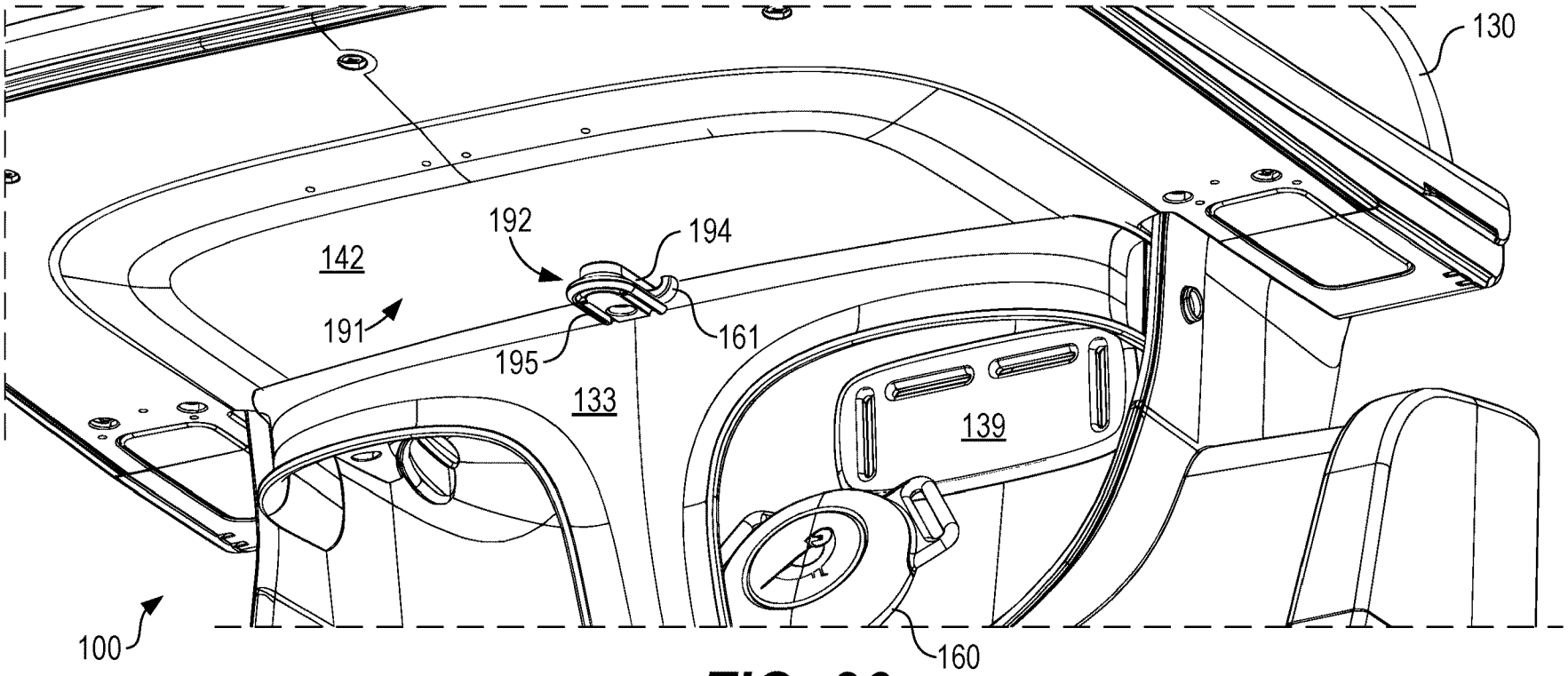
FIG. 26 is an isolated view of a crotch post of the convertible chair assembly according to various embodiments of the present disclosure.

FIG. 18 shows an enlarged view of a bucket seat connector 250, FIG. 19 shows the bucket seat 130 engaged with the bucket seat connector 250, and FIGS. 20-23 show various views of a coupling mechanism 251 that can be pill-shaped or ovular-shaped in some implementations. As noted above, the bucket seat 130 (and/or the infant seat assembly 109) can be removably attached to the support frame 103. The bucket seat 130 can include side bodies 253*a*, 253*b* (collectively "side bodies 253") that project laterally from the bucket seat 130, as shown in FIGS. 3 and 11. The bucket seat connector 250 can be coupled to the coupling mechanism 251 which, in turn, is coupled to the inner surface 220.

Referring to FIGS. 18 and 19, the side bodies 253 can include a recess 256 in which the bucket seat connector 250 and the coupling mechanism 251 are disposed. For instance, the side bodies 253 can slide over and couple to the bucket seat connector 250 and coupling mechanism 251 such that the bucket seat connector 250 nests or is seated within the recess 256 to form a snap connection, an interference connection, and/or a friction fit with the bucket seat connector 250 and the coupling mechanism 251. As shown in FIG. 18, the coupling mechanism 251 includes a lip 260, where a projection disposed within the recess 256 can slide over and engage with the lip 260 to form an interference connection therewith.

The bucket seat connector 250 can include a seat engagement 259 and clips 262*a*, 262*b* (collectively "clips 262"). A bottom of the side bodies 253 of the bucket seat 130 can be positioned in the recess 256 until the seat engagement 259 contacts an interior top surface of the recess 256. The clips 262 can be sized and positioned to engage interior sidewalls 265 of the recess 256, facilitating a friction connection, interference connection, or a latching connection.

Figure 14:
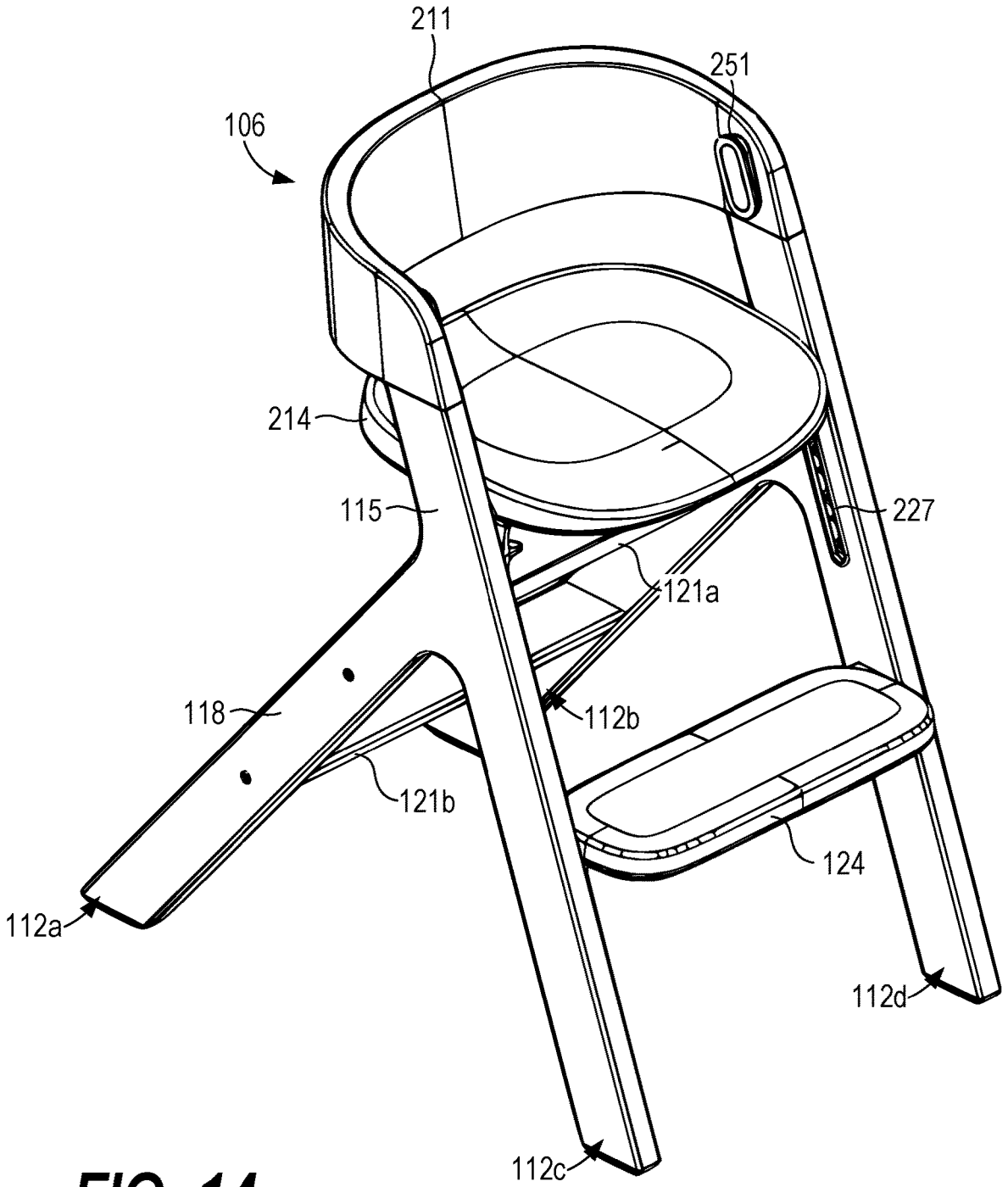
FIG. 14 is a top perspective view of the convertible chair assembly having an infant assembly removed according to various embodiments of the present disclosure.

In some embodiments, the bucket seat connector 250 can be removed from the inner surface 220 of the support leg member 118. For instance, the bucket seat connector 250 can be coupled to the coupling mechanism 251 (and the inner surface 220) via a screw or other connection mechanism. Thus, when a child outgrows the bucket seat 130, the bucket seat 130, the bucket seat connector 250, and the coupling mechanism 251 can be removed. FIG. 14, for example, shows the bucket seat connector 250 removed for explanatory purposes.

Referring specifically to FIGS. 20-23, various perspective views of the coupling mechanism 251 are shown according to various embodiments. The coupling mechanism 251 can include a body 263 that defines the lip 260. A lid 266 can cover a

The invention claimed is:

1. An infant chair assembly, comprising:

a support frame;

an infant seat assembly, the infant seat assembly comprising a seat configured to support an infant in a seated position;

a crotch post, wherein the crotch post comprises two horizontally-extending top members and a vertically-extending central member positioned orthogonal to the two horizontally-extending top members, the crotch post further comprising a notch and a notch lip positioned between the two horizontally-extending top members; and a harness assembly secured to the seat without having passed through or secured to a backside of the seat, the harness assembly comprising shoulder straps, waist straps, and a crotch strap, the crotch strap being secured to the front portion of the infant seat;

wherein the shoulder straps and waist straps are detachably attachable to a buckle, and wherein at least one of the shoulder straps, the waist straps, and the crotch strap is formed, at least in part, of a fiber-reinforced, silicone-coated material.

2. The infant chair assembly according to claim 1, wherein all of the shoulder straps, the waist straps, and the crotch strap are formed, at least in part, of the fiber-reinforced, silicone-coated material.

3. The infant chair assembly according to claim 1, further comprising a tray having a bottom surface and a projection extending downward relative to the bottom surface, the projection being sized and positioned to be positioned in and form an engagement with the notch and the notch lip of the crotch post.

4. The infant chair assembly according to claim 3, wherein:

the projection comprises a top projection portion and a bottom projection portion coupled to one another; and the top projection portion has a width less than a width of the notch and the notch lip, and the bottom projection portion has a width greater than the notch and the notch lip such that the top projection portion is nested within the notch, and the bottom projection portion is positioned below the notch lip, creating pressure between the projection and the notch lip of the crotch post.

5. A convertible infant chair assembly, comprising:

a support frame;

an infant seat assembly detachably attachable to the support frame, the infant seat assembly comprising a bucket seat configured to support an infant in a seated position; and a strap hub positioned at a backrest of the bucket seat, the strap hub comprising first and second ends disposed opposite one another, two vertically-oriented apertures disposed on the first and second ends, and two horizontally-oriented apertures, wherein:

the strap hub comprises a front portion having a contoured front surface, a rear portion having a body angled relative to the front portion, and an arm extending between the front portion and the rear portion;

the backrest of the bucket seat comprises an aperture; and the arm is disposed through the aperture such that the strap hub is fixed to the bucket seat and such that the contoured front surface of the front portion is substantially flush with the backrest of the bucket seat.

6. The convertible infant chair assembly according to claim 5, further comprising a harness assembly comprising strapping, the strapping comprising:

a first shoulder strap disposed through a first one of the two vertically-oriented apertures and a first one of the two horizontally-oriented apertures;

a second shoulder strap disposed through a second one of the two vertically-oriented apertures and a second one of the two horizontally-oriented apertures;

a crotch strap disposed through a bottom aperture of the bucket seat; and a buckle, wherein the first shoulder strap and the second shoulder strap are detachably attachable to the buckle.

7. The convertible infant chair assembly according to claim 6, wherein at least a portion of the strapping is formed of a silicone material or a fiber-reinforced silicone-coated material.

8. The convertible infant chair assembly according to claim 5, further comprising:

a toddler seat assembly comprising at least two of a backrest separate from the backrest of the bucket seat; a toddler seat; and a footrest, wherein the support frame comprises a plurality of support frame legs having a plurality of toddler seat tracks disposed on inner surfaces of the support frame legs, the toddler seat having a variable height adjustable relative to the backrest of the toddler seat assembly via the plurality of toddler seat tracks.

9. The convertible infant chair assembly according to claim 8, wherein the infant seat assembly comprises a rear support projecting from a rear surface of the bucket seat, the rear support comprising an edge configured to engage a surface of a toddler seat backrest.

10. The convertible infant chair assembly according to claim 5, further comprising a tray and a tray liner detachably attachable to the tray, the tray being configured to adjust horizontally relative to the bucket seat.

11. A convertible infant chair assembly, comprising:

a support frame;

an infant seat assembly detachably attachable to the support frame, the infant seat assembly comprising a bucket seat configured to support an infant in a seated position; and a strap hub positioned at a backrest of the bucket seat, the strap hub comprising first and second ends disposed opposite one another, two vertically-oriented apertures disposed on the first and second ends, and two horizontally-oriented apertures positioned between the two vertically-oriented apertures.

12. The convertible infant chair assembly according to claim 11, wherein:

the strap hub further comprises a front portion having a contoured front surface, a rear portion having a body angled relative to the front portion, and an arm extending between the front portion and the rear portion;

the backrest of the bucket seat comprises an aperture; and the arm is disposed through the aperture such that the strap hub is rigidly fixed to the bucket seat and such that the contoured front surface of the front portion is substantially flush with the backrest of the bucket seat.

13. The convertible infant chair assembly according to claim 12, further comprising a harness assembly comprising strapping, the strapping comprising:

a first shoulder strap disposed through a first one of the two vertically-oriented apertures and a first one of the two horizontally-oriented apertures;

a second shoulder strap disposed through a second one of the two vertically-oriented apertures and a second one of the two horizontally-oriented apertures;

a crotch strap disposed through a bottom aperture of the bucket seat; and a buckle, wherein the first shoulder strap and the second shoulder strap are detachably attachable to the buckle.

14. The convertible infant chair assembly according to claim 13, wherein at least a portion of the strapping is formed of a silicone material or a fiber-reinforced silicone-coated material.

15. The convertible infant chair assembly according to claim 11, further comprising:

a toddler seat assembly comprising at least two of a backrest separate from the backrest of the bucket seat; a toddler seat; and a footrest, wherein the support frame comprises a plurality of support frame legs having a plurality of toddler seat tracks disposed on inner surfaces of the support frame legs, the toddler seat having a height adjustable relative to the backrest of the toddler seat assembly via the plurality of toddler seat tracks.

16. The convertible infant chair assembly according to claim 15, wherein:

the toddler seat tracks are raceways comprising elongated recessed regions disposed in the inner surfaces of the support frame legs; and the convertible infant chair assembly further comprises a coupling mechanism coupled to a bottom surface of a toddler seat, the coupling mechanism comprising an aperture, and a pull knob being positioned through the aperture that mates the coupling mechanism to the inner surfaces of the support frame legs.

17. The convertible infant chair assembly according to claim 16, wherein the pull knob is a threaded pull knob capable of being twisted and pulled, thereby causing a rod to threadedly decouple from a slot nested in the raceways.

18. The convertible infant chair assembly according to claim 16, wherein the infant seat assembly comprises a rear support projecting from a rear surface of the bucket seat, the rear support comprising an edge configured to engage a surface of a toddler seat backrest.

19. The convertible infant chair assembly according to claim 11, further comprising a tray and a tray liner detachably attachable to the tray, the tray being configured to adjust horizontally relative to the bucket seat.

20. The convertible infant chair assembly according to claim 11, further comprising support frame legs of the support frame, a bucket seat connector, and a coupling mechanism, the bucket seat connector and the coupling mechanism both being detachably attached to an inner surface of the support frame legs, wherein the bucket seat comprises side bodies that project laterally from the bucket seat and the side bodies each comprise a recess in which the bucket seat connector and the coupling mechanism are slidably disposed.

21. The convertible infant chair assembly according to claim 20, wherein the coupling mechanism is ovular-shaped and comprises a lip, a projection disposed within the recess configured to slide over and engage with the lip to form an interference connection therewith.

22. The convertible infant chair assembly according to claim 21, wherein the bucket seat connector comprises a seat engagement and a plurality of clips, a bottom of the side bodies of the bucket seat configured to be positioned in the recess such that the seat engagement contacts an interior top surface of the recess and the clips engage interior sidewalls of the recess.

23. A convertible infant chair assembly, comprising:

a support frame;

an infant seat assembly detachably attachable to the support frame, the infant seat assembly comprising a bucket seat configured to support an infant in a seated position; and a bucket seat connector and a coupling mechanism both detachably attached to an inner surface of the support frame, wherein the bucket seat comprises side bodies that project laterally from the bucket seat and the side bodies each comprise a recess in which the bucket seat connector and the coupling mechanism are slidably disposed.

24. The convertible infant chair assembly according to claim 23, further comprising a strap hub and strapping positioned in the strap hub, wherein:

the strap hub comprises a front portion having a contoured front surface, a rear portion having a body angled relative to the front portion, and an arm extending between the front portion and the rear portion;

a backrest of the bucket seat comprises an aperture;

the arm is disposed through the aperture such that the strap hub is rigidly fixed to the bucket seat and such that the contoured front surface of the front portion is substantially flush with the backrest of the bucket seat;

a first shoulder strap is disposed through a first one of two vertically-oriented apertures and a first one of two horizontally-oriented apertures;

a second shoulder strap is disposed through a second one of the two vertically-oriented apertures and a second one of the two horizontally-oriented apertures;

a crotch strap is disposed through a bottom aperture of the bucket seat;

the first shoulder strap, the second shoulder strap, and the crotch strap are detachably attachable to a buckle; and at least a portion of the strapping is formed of a silicone material or a fiber-reinforced silicone-coated material.

* * * * *